US005581654A

United States Patent [19]

Tsutsui

[11] Patent Number: 5,581,654

[45] Date of Patent: Dec. 3, 1996

[54] METHOD AND APPARATUS FOR INFORMATION ENCODING AND DECODING

[75] Inventor: Kyoya Tsutsui, Kanagawa, Japan

[73] Assignee: Sony Corporation, Japan

[21] Appl. No.: 249,177

[22] Filed: May 25, 1994

[30] Foreign Application Priority Data

| | | | |
|---|---|---|---|
| May 25, 1993 | [JP] | Japan | 5-122919 |
| Jul. 26, 1993 | [JP] | Japan | 5-183988 |
| Sep. 30, 1993 | [JP] | Japan | 5-245750 |

[51] Int. Cl.[6] ..... G10L 9/00

[52] U.S. Cl. ..... 395/2.39; 395/2.35; 395/2.33; 395/2.29; 381/36; 381/37; 379/406; 379/410

[58] Field of Search ..... 381/36, 37, 40; 395/2.14, 2, 2.15, 2.2, 2.35, 2.21, 2.36, 2.25–2.33, 2.38, 2.39, 2.67, 2.4, 2.77, 2.43; 379/406, 410

[56] References Cited

U.S. PATENT DOCUMENTS

| | | | |
|---|---|---|---|
| 4,85,790 | 12/1989 | McAulay et al. | 381/36 |
| 3,349,183 | 10/1967 | Campanella . | |

(List continued on next page.)

FOREIGN PATENT DOCUMENTS

| | | | |
|---|---|---|---|
| 0349325A2 | 1/1990 | European Pat. Off. | G11B 20/10 |
| 0446031A3 | 9/1991 | European Pat. Off. | H04B 1/66 |
| 0458645A2 | 11/1991 | European Pat. Off. | H04B 1/66 |
| 0466190A2 | 1/1992 | European Pat. Off. | G11B 20/10 |
| 0463473A2 | 1/1992 | European Pat. Off. | G06F 15/332 |
| 0473367A1 | 3/1992 | European Pat. Off. | H03M 7/30 |
| 0506394A2 | 9/1992 | European Pat. Off. | G10L 7/00 |
| 0423050A1 | 4/1991 | France | H04B 1/66 |
| 0370277A3 | 5/1990 | Germany | H04B 1/66 |
| 01069181 | 3/1989 | Japan | H04N 7/137 |
| WO90/09064 | 8/1990 | WIPO | H04B 1/66 |
| WO91/16769 | 10/1991 | WIPO | H04B 1/66 |
| WO92/17884 | 10/1992 | WIPO | G11B 20/10 |

OTHER PUBLICATIONS

An application–specific FFT processor Electronic Engineering, Jun. 1988 pp. 100 and 104–106.

Application of Quadrature Mirror Filters To Split Band Voice Coding Schemes, Esteban et al., May 9–11, 1977 IEEE International Conference on Acoustics, Speech & Signal Processing, pp. 191–195.

Polyphase Quadrature Filters—A New Subband Coding Technique, Rothweiler ICASSP 1983, Boston, vol. 3, pp. 1280–1283.

The Critical Band Coder–Digital Encoding of Speech Signals Based on the Perceptual Requirements of the Auditory System, Krasner, 1080 IEEE, vol. 1–3, pp. 327–331.

An Application Specific DSP Chip for 100 MHZ Data Rates, Magar et al., IEEE Apr. 11–14, 1988—pp. 1989–1992.

Perceptual Transform Coding of Wideband Stereo Signals, James D. Johnston, ICASSP May 23–26, 1989, vol. 3, pp. 1993–1996.

Signal Compression: Technology Targets and Research Directions, Nikil Jayant, IEEE Jun. 1992, vol. 10, No. 5, pp. 796–818.

Subband/Transform Coding Using Filter Bank Designs Based on Time Domain Aliasing Cancellation, Princen et al., 1987 ICCC, pp. 2161–2164.

*Primary Examiner*—Kee M. Tung
*Attorney, Agent, or Firm*—Limbach & Limbach L.L.P.

[57] ABSTRACT

Pre-echo in the encoding and encoding of digital audio signals is diminished by utilizing a frequency dividing circuit for dividing the input audio signals into plural bands, normalization circuits for normalizing the frequency components for each frequency band and quantization circuits for an quantizing output of the normalization circuits. The frequency dividing circuit includes a unit for detecting a position in the signal waveform in which the quantization noise not masked by the signal components, that is the pre-echo, is estimated to be generated for producing the signal suppressing information. This signal suppressing information is also quantized as is the quantized output.

48 Claims, 23 Drawing Sheets

U.S. PATENT DOCUMENTS

| | | | |
|---|---|---|---|
| 4,184,049 | 1/1980 | Crochiere et al. | 179/1 SA |
| 4,516,241 | 5/1985 | Farah et al. | 370/110.1 |
| 4,535,472 | 8/1985 | Tomcik | 381/31 |
| 4,569,058 | 2/1986 | Grallert | 375/27 |
| 4,573,187 | 2/1986 | Bui et al. | 381/43 |
| 4,622,598 | 11/1986 | Doi et al. | 360/22 |
| 4,625,286 | 11/1986 | Papamichalis et al. | 364/513.5 |
| 4,697,212 | 9/1987 | Osawa et al. | 360/48 |
| 4,706,265 | 11/1987 | Furukawa | 375/122 |
| 4,748,579 | 5/1988 | Zibman et al. | 364/736 |
| 4,873,589 | 10/1989 | Inazawa et al. | 360/53 |
| 4,882,754 | 11/1989 | Weaver et al. | 381/35 |
| 4,903,301 | 2/1990 | Kondo et al. | 381/30 |
| 4,912,763 | 3/1990 | Galand et al. | 381/31 |
| 4,932,062 | 6/1990 | Hamilton | 381/43 |
| 4,949,383 | 8/1990 | Koh et al. | 381/31 |
| 5,016,107 | 5/1991 | Sasson et al. | 358/209 |
| 5,040,217 | 8/1991 | Brandenburg et al. | 381/47 |
| 5,150,387 | 9/1992 | Yoshikawa | 375/122 |
| 5,159,611 | 10/1992 | Tomita et al. | 375/34 |
| 5,204,677 | 4/1993 | Akagiri et al. | 341/118 |
| 5,218,561 | 6/1993 | Iwadare | 364/725 |
| 5,222,189 | 6/1993 | Fielder | 395/2 |
| 5,241,603 | 8/1993 | Akagiri et al. | 381/37 |
| 5,243,588 | 9/1993 | Maeda et al. | 369/54 |
| 5,264,846 | 11/1993 | Oikawa | 341/76 |
| 5,268,685 | 12/1993 | Fujiwara | 341/76 |
| 5,285,476 | 2/1994 | Akagiri et al. | 375/25 |
| 5,294,925 | 3/1994 | Akagiri | 341/50 |
| 5,311,561 | 5/1994 | Akagiri | 375/122 |
| 5,381,143 | 1/1995 | Shimoyoshi et al. | 341/51 |
| 5,384,891 | 1/1995 | Asakawa et al. | 395/2.29 |
| 5,388,093 | 2/1995 | Yoshida et al. | 369/124 |
| 5,388,181 | 2/1995 | Anderson et al. | 395/2.12 |
| 5,388,209 | 2/1995 | Akagiri | 395/2.38 |
| 5,406,428 | 4/1995 | Suzuki | 360/53 |
| 5,461,378 | 10/1995 | Shimoyoshi et al. | 341/51 |
| 5,471,558 | 11/1995 | Tsutsui | 395/2.28 |

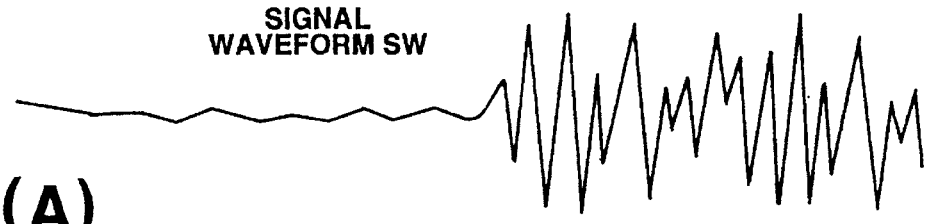
FIG.7(A)
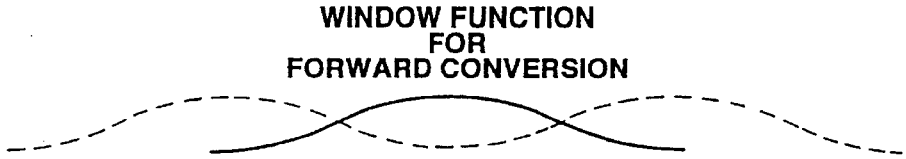
FIG.7(B)
FIG.7(C)
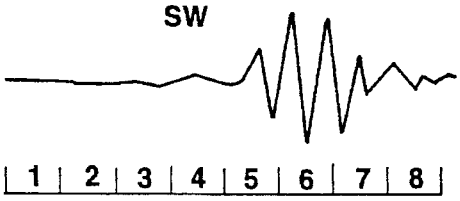
FIG.7(D)
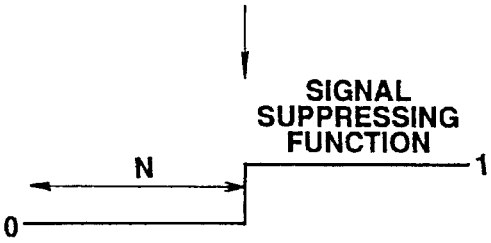

METHOD AND APPARATUS FOR INFORMATION ENCODING AND DECODING

BACKGROUND OF THE INVENTION

This invention relates to a method and apparatus for information encoding and decoding wherein input digital data is encoded by high efficiency encoding and recorded and subsequently reproduced and decoded to produce playback signals.

There have hitherto been proposed a variety of techniques for high efficiency encoding for audio or speech signals, for example, a sub-band coding (SBC) in which audio signals on the time axis are divided into plural frequency ranges without dividing the audio signals on the time axis into blocks at an interval of unit time, or a blocking and frequency dividing system, that is a so-called transform encoding system, in which signals on the time axis are blocked at a pre-set unit time and converted into signals on the frequency axis on the block basis, and the resulting spectral signals are divided into plural frequency bands and encoded on the band basis. There is also a technique of high efficiency encoding consisting in a combination of the sub-band coding and the transform coding, according to which audio signals are divided into plural frequency ranges by SBC and transform coding is independently applied to each of the frequency ranges.

Known filters for dividing a frequency spectrum into a plurality of frequency ranges include the quadrature mirror filter (QMF), as discussed in, for example, R. E. Crocherie, Digital Coding of Speech in Subbands, 55 Bell Syst. Tech. J., No. 8 (1976). The technique of dividing a frequency spectrum into equal-width frequency ranges is discussed in Joseph H. Rothweiler, Polyphase Quadrature Filter—A New Subband Coding Technique, ICASSP 83 Boston.

Known techniques for orthogonal transform include the technique of dividing the digital input audio signals into frames of a predetermined time duration, and processing the resulting frames using a Fast Fourier transform (FFT), discrete cosine transform (DCT) or modified DCT (MDCT) to convert the signals from the time axis to the frequency axis. Discussion of a MDCT may be found in J. P. Princen and A. B. Bradley, Subband/Transform Coding Using Filter Bank Based on Time Domain Aliasing Cancellation, ICASSP 1987.

With the above-described high efficiency coding, signals divided into plural frequency bands by a filter or spectrum conversion may be quantized for controlling the range subjected to quantization noise. High efficiency coding may be achieved by taking advantage of, for example, masking effects, in order to take into account the psychoacoustic characteristics of the human hearing mechanism. If signals are normalized before quantization with the maximum value of absolute values of signal components in each frequency band, encoding may be achieved with higher efficiency.

In making the division of the frequency spectrum into plural bands for quantization, it may be made so that the human auditory characteristics are taken into account. That is, audio signals may be divided into plural, for example, 25 bands, in accordance with the critical bands in which the bandwidths become broader towards higher frequency. The data in each critical band is encoded by fixed or adaptive bit allocation. For example, when encoding coefficient data produced by MDCT operations, the MDCT coefficient data for each band, produced by the MDCT operations on the block basis, is encoded with an adaptively allocated number of bits. The following two techniques are known as the bit allocation technique.

Known adaptive bit allocation techniques include that described in IEEE TRANS. ON ACOUSTICS, SPEECH, AND SIGNAL PROCESSING, VOL.ASSP-25, No.4 (1977 August) in which bit allocation is carried out on the basis of the amplitude of the signal in each critical band. This technique produces a flat quantization noise spectrum and minimizes noise energy, but the noise level perceived by the listener is not optimum because the technique does not effectively exploit the psychoacoustic masking effect.

In the bit allocation technique described in M. A. Krasner, The Critical Band Encoder-Digital Encoding of the Perceptual Requirements of the Auditory System, ICASSP 1980, the psychoacoustic hearing mechanism is used to determine a fixed bit allocation that produces the necessary signal-to-noise ratio for each critical band. However, if the signal-to-noise ratio of such a system is measured using a strongly tonal signal, such as a sine wave, non-optimum results are obtained because of fixed allocation of bits among the critical bands.

In order to solve these problems, there is proposed a high efficiency encoding apparatus in which the total number of bits available for bit allocation is divided into those for fixed bit allocation for each sub-block divided from a block and those for bit allocation dependent on the signal energy in each block. The division ratio is set in dependence upon a signal related to the input signal so that the smoother the signal spectrum, the larger becomes the division ratio for the fixed bit allocation.

With this method, if the energy is concentrated in a particular spectral component, as in the case of a sine wave, a larger number of bits may be allocated to a block containing the spectral component for improving the overall signal to noise characteristics. This is effective in improving not only measured values, but also the sound quality as perceived by the ear, inasmuch as the human auditory system is usually extremely sensitive to a signal having sharp spectral components.

There are also a variety of methods for bit allocation and expectation may be made of an encoding with still higher efficiency if the model concerning the human auditory system is refined and an encoding device with a higher capacity is devised.

If the original signal contains acutely changed signal components, which are not necessarily adjacent to signal waveform portions with larger signal amplitudes, the quantization noise on the waveform signal is occasionally increased in the original signal waveform portions not having larger signal amplitudes. The quantization noise generated in the portions of the original signal waveform not having larger signal amplitudes becomes objectionable to the ears because it cannot be covered by concurrent masking by the signals of the acutely changing waveform portions. Above all, if the waveform signals are converted by spectrum conversion into a large number of frequency components, time resolution is lowered such that a larger quantization noise is generated for an extended time. If, for example, the conversion length of the spectrum conversion is reduced, the period in which the quantization noise is generated is also reduced. However, the frequency resolution then is also lowered and the encoding efficiency in the sub-stationary portion is lowered. If the above-mentioned spectrum conversion followed by inverse spectrum conversion is utilized, the quantization noise is produced which is not masked by concurrent masking by acutely changing signal portions. Such quantization noise generated temporally before the acutely changing signal portion is termed the pre-echo, which will be explained subsequently in detail.

For obviating such inconvenience, there is proposed a method of using a variable conversion length so that the conversion length is shortened only in the acutely changed signal waveform portions at the cost of the frequency resolution.

In FIGS. 1 and 2, a frequency dividing circuit and a frequency range synthesizing circuit in an encoding apparatus disclosed in EP Laid-Open Patent Publication No. 0537361 (Laying-Open Date, Apr. 21, 1993) are shown in a block circuit diagram. In the dividing and synthesizing circuits, the conversion length for spectrum conversion is designed to be variable.

Referring to FIG. 1, showing the frequency dividing circuit, the input audio signal supplied to an input terminal 300 is sent to a first stage frequency dividing filter 301 of a dual filter 301–302. The filter 301 divides the signal into two frequency band signals one of which is sent to the next stage frequency dividing filter 302. The filter 302 divides the signal from the filter 301 into two frequency band signals. Thus the input audio signal, supplied to the terminal 300, is divided by the filters 301 and 302 into three frequency bands.

The respective band signals from the frequency dividing filters 301, 302 are supplied to associated forward spectrum conversion circuits 321, 322 and 323 so as to be thereby converted to spectral signals. These forward spectrum conversion circuits may be implemented by the above-mentioned MDCT device.

The above arrangement is characterized by the variable conversion length of the forward spectrum conversion in each forward spectrum conversion circuit. Such conversion length is determined based upon the band signals by conversion length decision circuits 311, 312 and 313. By using the variable conversion lengths, both the sub-stationary waveform portions and the transient signal waveform portions can be encoded with psychoacoustically high encoding efficiency, as will be explained subsequently.

The spectral signals from the forward spectrum conversion circuits 321, 322 and 323 are grouped among pre-set frequency bands, for example, critical frequency bands. The conversion length information from each of the conversion length decision circuits 311 to 313 is outputted at terminals 303, 305 and 307, respectively. Outputs of the terminals 303 to 308 are processed by normalization and quantization circuits, not shown, and converted into a code string by a multiplexor, also not shown, so as to be transmitted or recorded on a recording medium.

FIG. 2 shows, in a block circuit diagram, an arrangement of a frequency range synthesizing circuit of a decoding device for decoding signals encoded by the encoding device having the frequency dividing circuit shown in FIG. 1.

Referring to FIG. 2, the code string from the encoding device is divided by a demultiplexor, not shown, provided in a pre-stage of each inverse spectrum conversion circuit 421, 422 of the frequency band synthesizing circuit, inverse-quantized and inverse-normalized and grouped among three bands associated with outputs of the frequency dividing filter shown in FIG. 1. The band-based conversion length data associated with outputs of the terminals 303, 305 and 307 of FIG. 1 are supplied to terminals 401, 402 and 403, respectively, while the spectral data associated with outputs of the terminals 304, 306 and 308 of FIG. 1 are supplied to terminals 411, 412 and 413, respectively.

The band-based data are supplied to associated inverse spectrum conversion circuits 421, 422 and 423 which calculate three-band signals based upon the input data. These three-band signals are fed to a dual frequency range synthesizing filter 424–431.

Outputs of the inverse spectrum conversion circuits 422 and 423 are synthesized by a frequency range synthesizing filter 424, while outputs of the inverse spectrum conversion circuits 421 and 424 are synthesized by a frequency range synthesizing filter 431. The synthesizing filter 431 produces band-synthesized audio signals which are outputted at a terminal 430.

Referring to FIGS. 3(A) to FIG. 3(D), the effect of providing for the variable conversion length in the frequency dividing circuit and the frequency synthesizing circuit shown in the arrangements of FIGS. 1 and 2 is explained.

For a sub-stationary signal waveform in general, a longer conversion length, which may be achieved using a conversion window function having a long conversion length as shown in FIG. 3(A), gives a higher encoding efficiency, because the energy is thereby concentrated in particular spectral coefficients.

However, if the signal waveform is converted into spectral signals which are then inverse-converted into signals on the time axis, the quantization noise is substantially uniformly distributed within a conversion block (block employed during conversion into spectral signals). Consequently, if the long conversion length is used in the acutely changing signal waveform portion, a larger quantization noise QN is produced even in a small-amplitude waveform portion, as shown in FIG. 3(B). This noise QN is not psychoacoustically masked by the concurrent masking effect by the acutely changing signal waveform SW.

The masking effect comprises, in addition to the concurrent masking, the forward masking in which temporally previous sound masks the temporally succeeding sound, and a backward masking in which temporally succeeding sound masks the temporally preceding sound. The backward masking manifests its effect only for a brief time period as compared to the forward masking. Thus the quantization noise temporally previous to the waveform portion having a rapidly increased sound is extremely objectionable to the ear as the pre-echo.

Consequently, spectrum conversion may be made with a short conversion length (short conversion window function) in one of the bands in which the signal becomes suddenly larger, as shown in FIG. 3(D), thereby reducing the period in which the quantization noise QN is produced, as shown in FIG. 3D, so that the masking by the backward masking becomes effective.

Long and short conversion lengths may also be used in combination. FIGS. 4(A) and 4(B) show the state in which conversion is being made with the long and short conversion lengths. If there is the acutely changing signal, as shown in FIG. 4B, the conversion window function is changed over from the long conversion window function to the short conversion window function at the acutely changing waveform portion, as shown in FIG. 4A.

Although psychoacoustically efficient encoding may be achieved in this manner not only for the sub-stationary signal waveform portion but also for the transient waveform portion, the number of the spectral components are variable from one conversion block to another, because of the variable conversion length, thereby complicating the encoding and decoding apparatus. That is, if the conversion length is variable, it is necessary to provide conversion means capable of coping with variable conversion length in the encoding and decoding apparatus. In addition, since the number of spectral components is proportional to the conversion length, the frequency band associated with the spectral components is varied with the conversion lengths, so that, if the spectral components are grouped among the critical bands for encoding, the number of the spectral components comprised within each critical band also becomes different, thus complicating the encoding and decoding operations.

SUMMARY OF THE INVENTION

It is an object of the present invention to provide an information encoding method and apparatus and an information decoding method and apparatus wherein the apparatus is simplified in structure, while the encoding efficiency in the sub-stationary waveform portion is increased and psychoacoustic hindrance is not produced by the pre-echo.

In view of the above object, the present invention provides an information encoding method for encoding input digital data comprising the steps of quantizing spectral signals based on the input digital data, detecting a period the pre-echo is produced in the input digital data, and transmitting the pre-echo information for preventing the occurrence of the pre-echo.

The present invention also provides an information decoding method for decoding encoded digital data comprising the steps of separating quantized signals and the pre-echo information from encoded digital data and inverse quantizing the quantized signals for generating spectral signals, and performing a pre-echo preventing operation on the spectral signals depending on the pre-echo information.

The present invention also provides an information encoding apparatus for encoding input digital data comprising means for quantizing spectral data which is based on the input digital data for generating quantized signals, means for detecting a period in which a pre-echo of the input digital data is generated, and means for multiplexing the pre-echo information for preventing the pre-echo and the quantized signals.

The present invention also provides an information decoding apparatus for decoding encoded digital data comprising means for separating quantized signals and the pre-echo information from encoded digital data and inverse-quantizing the quantized signals for generating spectral signals, and means for performing a pre-echo preventing operation on the spectral signals depending on the pre-echo information.

BRIEF DESCRIPTION OF THE DRAWINGS

FIGS. 7(A) to 7(G) illustrate the operating principle of pre-echo suppression according to the present invention.

DESCRIPTION OF PREFERRED EMBODIMENTS

Figure 1:
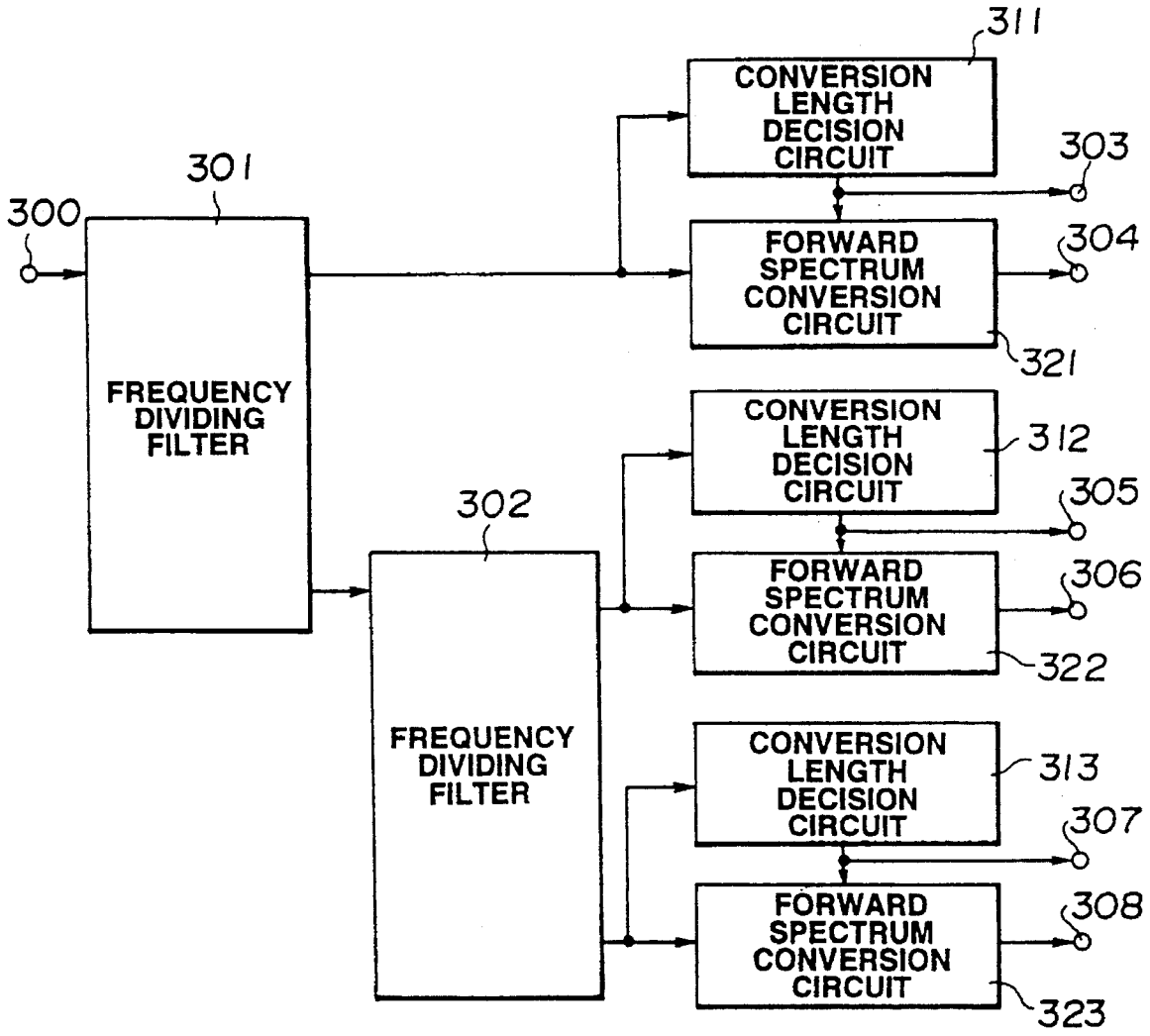
FIG.1 (PRIOR ART)
FIG. 1 is a schematic block circuit diagram showing an arrangement of a conventional frequency dividing circuit.
Figure 2:
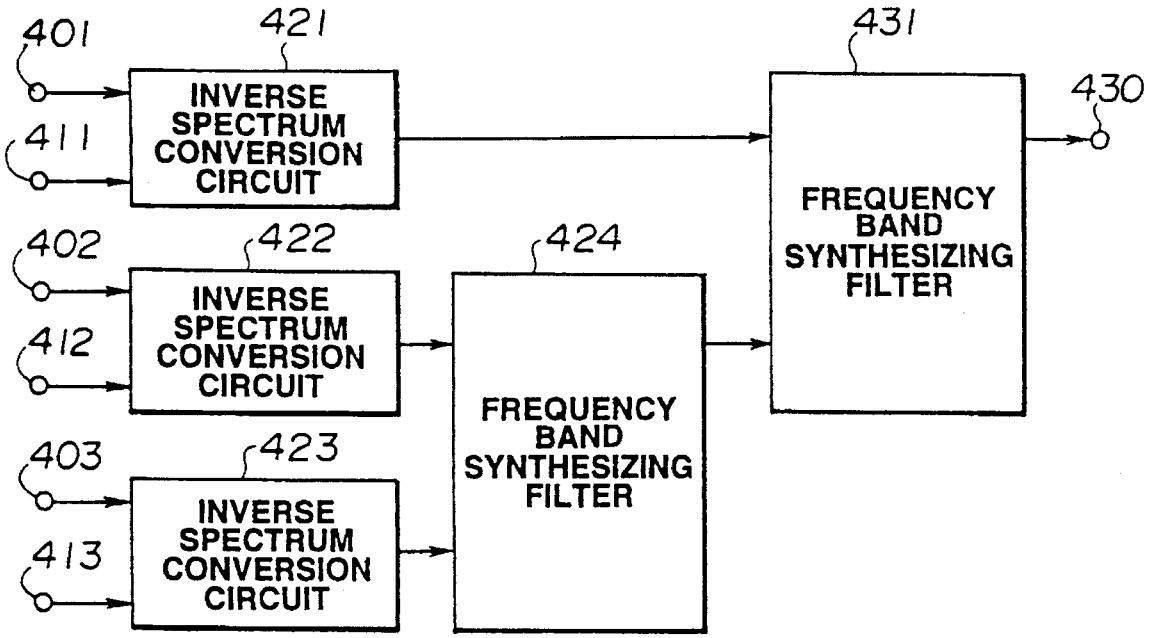
FIG.2 (PRIOR ART)
FIG. 2 is a schematic block circuit diagram showing an arrangement of a conventional frequency range synthesizing circuit.
Figure 3A:
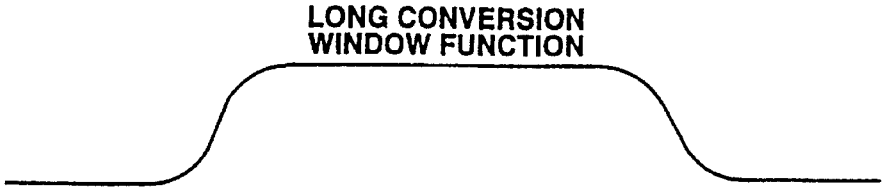
FIG.3(A) (PRIOR ART)
FIGS. 3(A) to 3(D) illustrate the operating principle and the effect of conversion length variation according to the prior art.
Figure 3B:
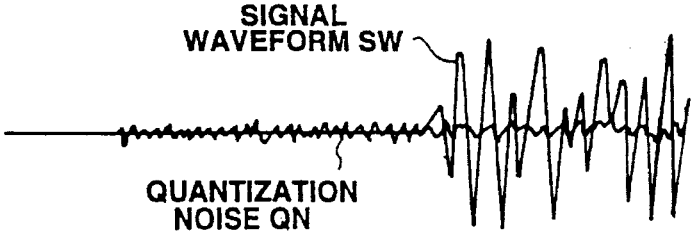
FIG.3(B) (PRIOR ART)
Figure 3C:
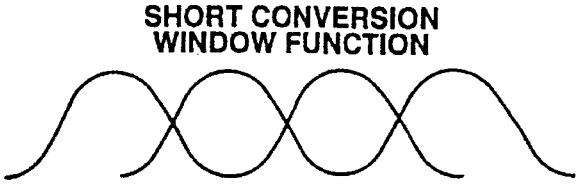
FIG.3(C) (PRIOR ART)
Figure 3D:
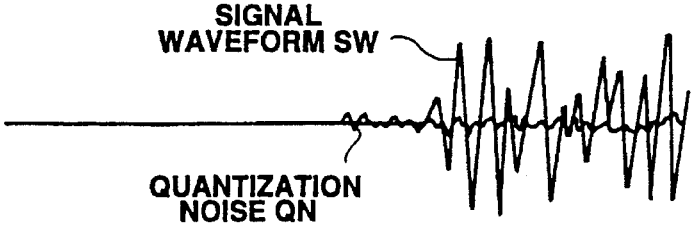
FIG.3(D) (PRIOR ART)
Figure 4A:
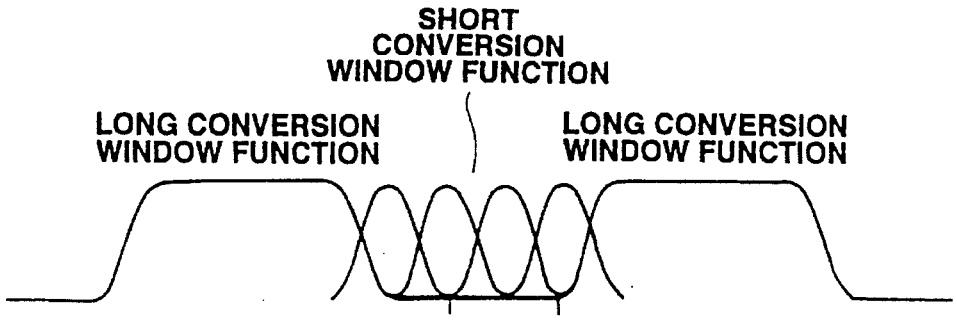
FIG.4(A) (PRIOR ART)
FIGS. 4(A) and 4(B) illustrate the state of co-existence of different conversion lengths according to the prior art.
Figure 4B:
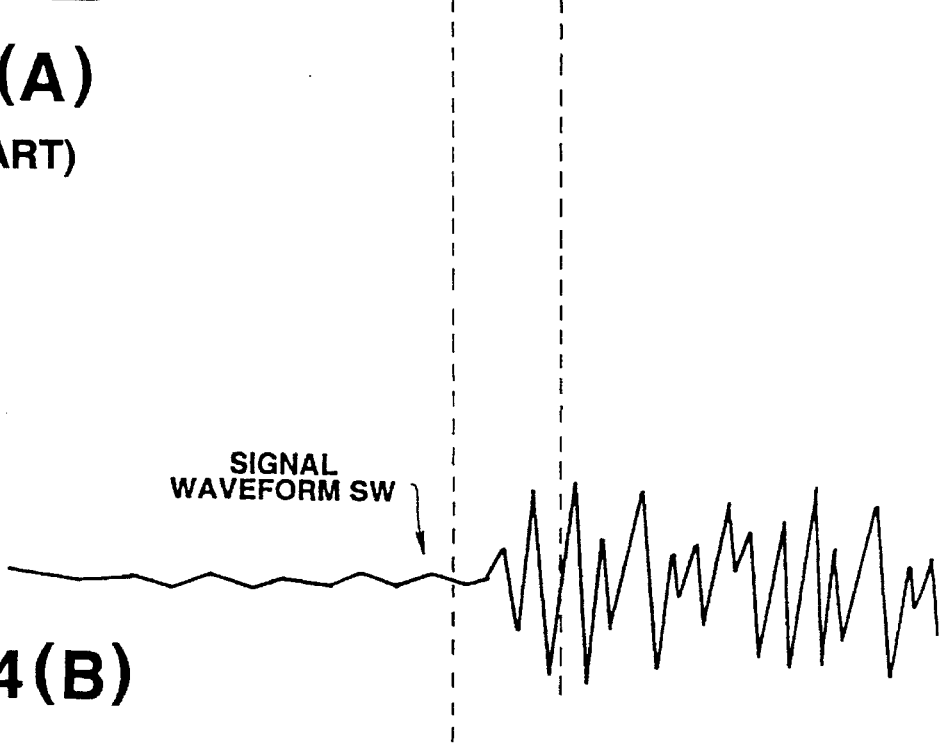
FIG.4(B) (PRIOR ART)

Referring to the drawings, preferred embodiments of the present invention will be explained in detail.

Figure 5:
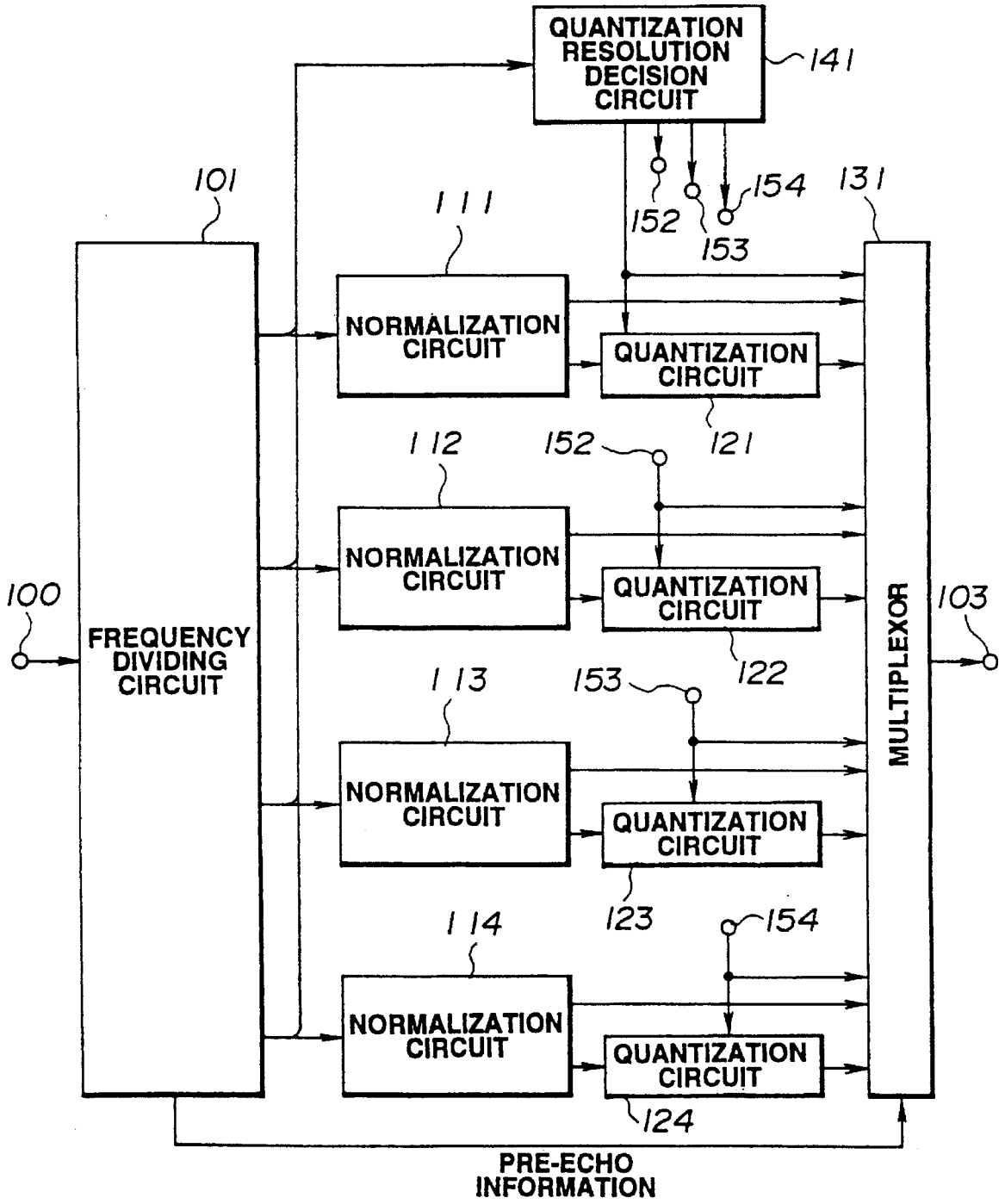
FIG. 5 is a schematic block circuit diagram showing an arrangement of an encoding device according to an embodiment of the present invention.

FIG. 5 shows, in a block circuit diagram, an encoding device for carrying out the information encoding method according to the present invention.

Referring to FIG. 5, audio signals entering the encoding device via an input terminal 100 are divided into plural frequency bands by a frequency dividing circuit 101. As frequency dividing means employed in the frequency dividing circuit 101, the above-mentioned filter, such as the QMF filter, may be employed, or spectral data obtained by spectral conversion by, for example, MDCT, may be grouped into plural frequency bands. Alternatively, the input audio signals may be divided by a filter into a number of frequency ranges and the signals in the respective frequency ranges may be converted into spectral signals which are grouped in plural frequency bands. The frequency bands produced by frequency division may be of equal widths or of unequal widths conforming to critical bands. Although FIG. 5 shows an example of dividing the input signals into four frequency bands, the input signals may also be divided into a larger number or a smaller number of frequency bands.

The input signals divided in frequency by the frequency dividing circuit 101 are normalized by normalizing circuits 111, 112, 113 and 114 associated with the frequency bands, at an interval of a pre-set time block, and thereby resolved into normalization coefficients and normalized signals. The normalized signals are quantized by quantization circuits 121, 122, 123 and 124, based upon an output signal of a quantization resolution decision circuit 141, and thereby converted into quantized normalized signals. In FIG. 5, while the quantization resolution information is supplied from the quantization resolution decision circuit 141 to the quantization circuits 121 to 124, the quantization resolution information to be routed to the quantization circuits 122, 123 and 124 is routed via terminals 152, 153 and 154 to the associated circuits, respectively.

The normalized quantized signals from the quantization circuits 121 to 124, the normalization coefficients from the normalization circuits 111, 112, 113 and 114, the quantization resolution information from the quantization resolution decision circuit 141 and the pre-echo information are multiplexed by a multiplexor 131 into a sequential code string which is outputted at a terminal 103. This code string is recorded on a recording medium, such as a disc-shaped or tape-shaped recording medium, or transmitted via a transmission system.

Although the quantization resolution decision circuit 141 calculates the quantization resolution based upon signals divided into plural frequency bands by the frequency dividing circuit 101, for the embodiment shown in FIG. 5, it may also be calculated from the signals at the input terminal 100, that is from the signals which are not as yet divided into plural frequency bands, or it may be calculated based upon the normalization coefficients from the normalization circuits 111 to 114. In addition, the phenomenon related with the human auditory system, such as the masking effects, may be taken into account in making calculations by the quantization resolution decision circuit 141. The quantization resolution information is outputted via the multiplexor 131 and subsequently routed to a decoding device. Thus a model simulating the human auditory sense, employed by the decoding device, may be selected in accordance with the manner of the above calculations.

Figure 6:
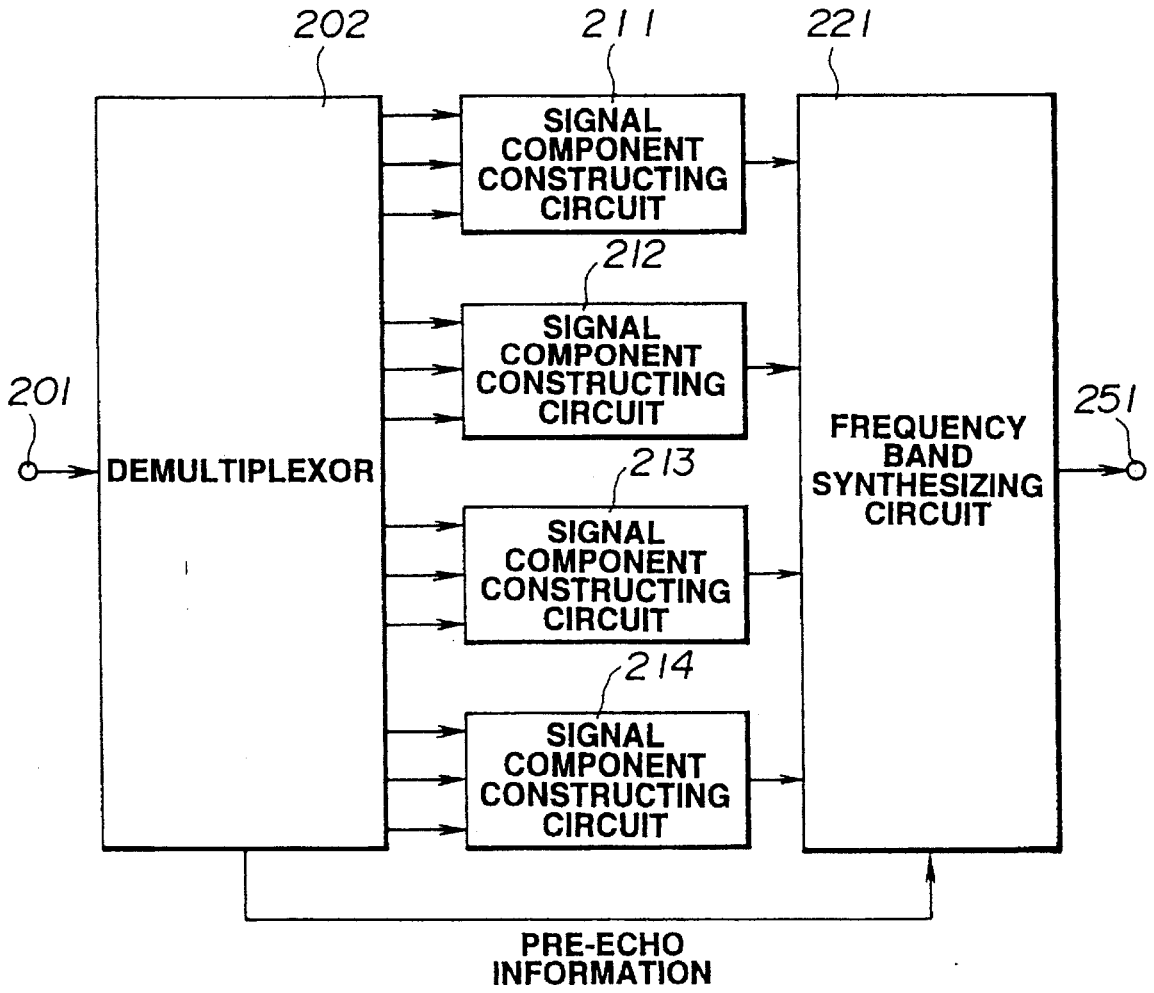
FIG. 6 is a schematic block diagram showing a decoding device according to an embodiment of the present invention.

FIG. 6 shows, in a block circuit diagram, a decoding device, a counterpart device of the encoding device shown in FIG. 5, is adapted for carrying out the information decoding method of the present invention.

Referring to FIG. 6, input code data entering a terminal 201 of the present decoding device (the above-mentioned code string) is fed to a demultiplexor 202 so as to be separated and restored to the quantization resolution information, normalization coefficients, normalized and quantized signals and the pre-echo signals for each of the frequency bands. The quantization resolution information, normalization coefficients and the normalized quantized signals for each frequency band are routed to signal component constructing circuits 211, 212, 213 and 214 associated with the respective bands for constructing the signal components for the respective bands. The signal components from the signal component constructing circuits 211, 212, 213 and 214 are synthesized by a frequency band synthesizing circuit 221 to produce audio signals which are outputted at a terminal 251.

Referring now to FIGS. 7(A) to 7(G), the principle of the method for suppressing the pre-echo according to a first embodiment of the present invention.

FIG. 7(A) shows a signal waveform SW in a frequency band as divided from a frequency spectrum by a filter, not shown, of the frequency dividing circuit 101 of the encoding device. In the present embodiment, the signal waveform SW shown in FIG. 7(A), presenting acute changes, is multiplied with a window function for forward conversion as shown in FIG. 7B, so that the signal waveform SW shown in FIG. 7(C) is converted into spectral signals. In the device of the present embodiment, it is detected in parallel where the signals are changed acutely. In the present case, signals are increased suddenly as from a fifth one of eight sub-domains shown in FIG. 7(C). Consequently, the pre-echo due to the quantization errors is produced for the first to fourth sub-domains as from the leading end of the conversion domain constituted by first to eighth sub-domains.

Figure 7E:
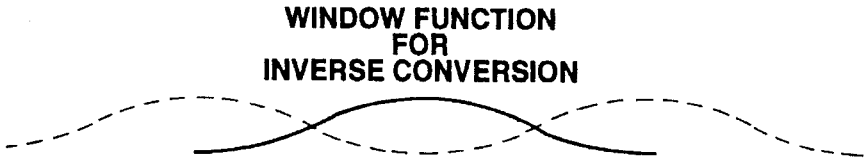
Figure 8:
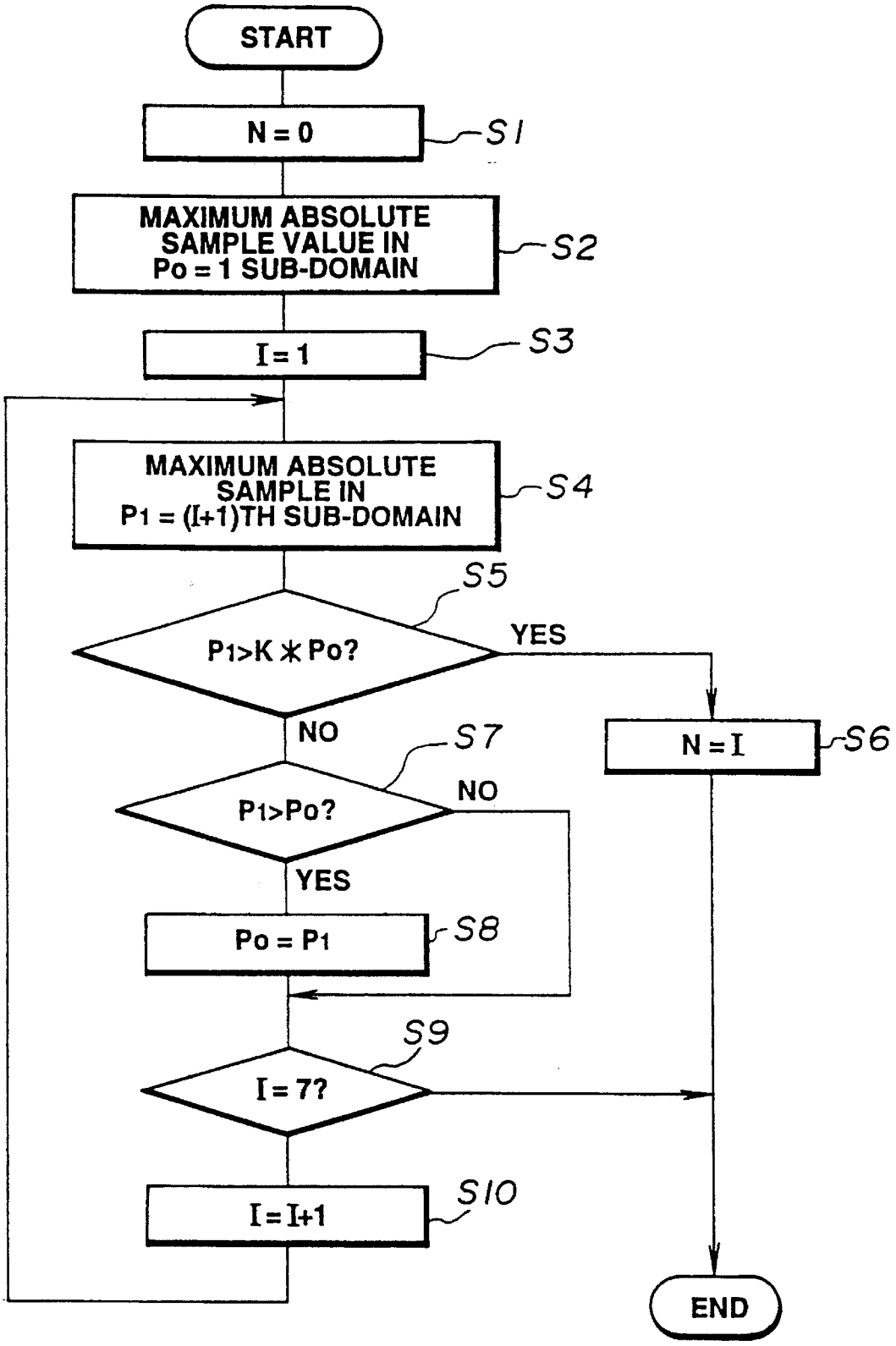
FIG. 8 is a flow chart showing the flow of processing operations for finding the duration of the pre-echo according to the present invention.

FIG. 8 shows the flow of the processing operations for finding the duration (length) N of the domain of occurrence of the pre-echo, that is the duration N shown in FIG. 7(D). In the present embodiment, if the maximum absolute value of plural samples in a given one of the sub-domains is equal to K times the maximum absolute value of plural samples of previous sub-domains, where K is a pre-set value, the pre-echo is deemed to be produced during the sub-domains previous to the given one of the sub-domains. Thus the duration N of the domain in which the pre-echo is found.

Referring to FIG. 8, the value of the duration N is initialized to zero at a step S1. At the next step S2, the maximum absolute value of plural samples of a first sub-domain shown in FIG. 7C is set to $P_0$. At the next step S3, a variable I indicating the numbers of the sub-domains is set to 1 and, at the next step S4, the absolute value of samples of the next (I+1)th sub-domain is set to $P_1$.

At the next step S5, the absolute value $P_1$ of the (I+1)th sub-domain is compared to the maximum absolute value of sample of the previous sub-domain multiplied by K. If the result of comparison is YES, that is if $P_1>K\times P_0$, control proceeds to a step S6. If the result is NO, that is if the inequality $P_1>K\times P_0$ does not hold, control proceeds to a step S7.

At the step S6, the value of I is set to the duration N. The processing then comes to an end.

At the step S7, the values $P_0$ and $P_1$ are compared to each other. If the result of comparison at the step S7 is YES, that is if $P_1>P_0$, control proceeds to a step S8. If result is NO, that is if the inequality $P_1>P_0$ does not hold, control proceeds to a step S9.

At the step S8, $P_0$ is set to $P_1$ ($P_0=P_1$). At the next step S9, it is checked whether or not the variable I is equal to 7, that is whether or not the processing operation has advanced to the eighth sub-domain. If the result of decision is YES, that is if I is decided to be equal to 7 (I=7) at the step S9, the processing operation comes to an end. If the result is NO, control reverts to the next step S10.

At the step S10, I is set to (I+1) (I=I+1), after which control reverts to the step S4 in order to repeat the above-mentioned processing operations as from the step S4.

The duration N of the domain of occurrence of the pre-echo thus found is sent from the encoding device to the decoding device as the control information, that is as the pre-echo information, for suppressing signal components for preventing the pre-echo. The control information "0" herein denotes that the signal is to be suppressed, as shown in FIG. 7(D).

Consequently, the decoding device converts spectral signals into waveform signals and subsequently suppresses the waveform signals to a zero sample value in the waveform portion corresponding to the designated domain affected by pre-echo. The decoding device then multiplies the waveform signals by a window function for inverse conversion as shown in FIG. 7(E) for synthesis with the previous and posterior conversion domains. Although the original signal components tend to be suppressed along with the pre-echo component, such suppression occurs only during a brief interval so that alien aural feeling is not that high.

Figure 9:
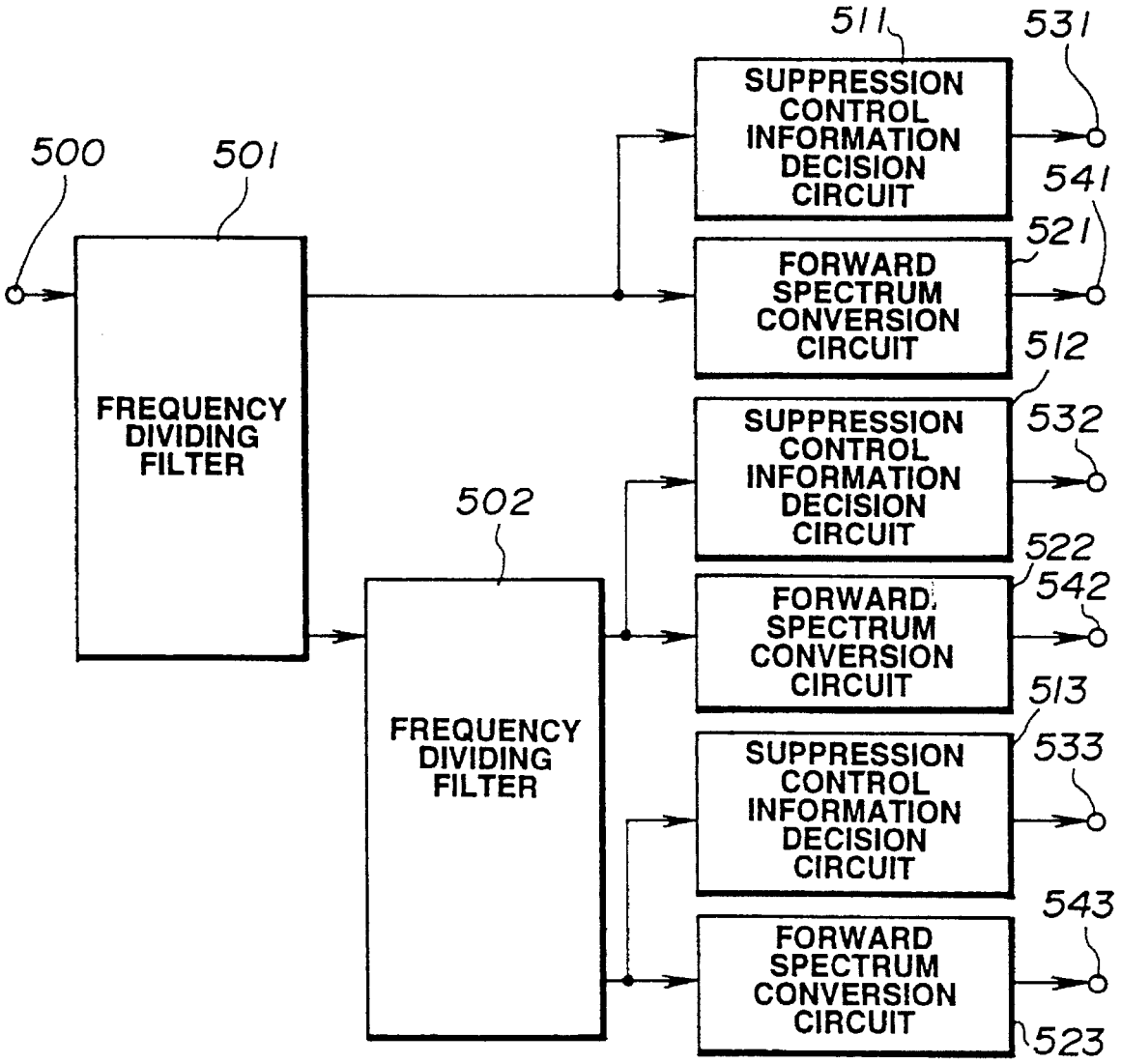
FIG. 9 is a block circuit diagram showing an arrangement of a frequency dividing circuit for an encoding device according to a first embodiment of the present invention.

FIG. 9 shows an arrangement of a frequency range dividing circuit of an encoding device according to a first embodiment of the present invention.

Referring to FIG. 9, showing an arrangement of the frequency range dividing circuit 101 shown in FIG. 5, input audio signals are supplied from the terminal 100 of FIG. 5 and routed to a pre-stage frequency dividing filter 501 of a dual-stage frequency dividing filter 501–502. One of the frequency bands divided from a frequency spectrum by the filter 501 is supplied to the filter 502 which further divides the frequency of the signals from the filter 501. Thus the input audio signal supplied to the terminal 500 is divided by the frequency dividing filters 501, 502 into three frequency bands.

The frequency band signals from the frequency dividing filters 501, 502 are routed to forward spectrum conversion circuits 521, 522 and 523 associated with the respective frequency bands, and thereby converted into respective spectral signals. These forward spectrum converting circuits may be implemented by, for example, the above-mentioned MDC.

The conversion length for the forward spectral conversion by the forward spectrum conversion circuits 521, 522, 523 herein is set to a constant value, as explained in connection with FIG. 7.

The signals for the respective frequency bands from the frequency dividing filters 501, 502 are also routed to suppression control information decision circuits 511, 512 associated with the respective frequency bands. These suppression control information decision circuits 511, 512 set the suppression control information as explained in connection with FIGS. 7(A) to 7(E) and 8.

The spectral signals from the forward spectrum converting circuits 521, 522 and 523 and the suppression control information as the pre-echo information from the suppression control information decision circuits 511, 512 and 513 are outputted to the multiplexor 131 via terminals 541, 542 and 543 and terminals 531, 532 and 533, respectively, and are grouped according to pre-set frequency bands, such as critical bands, before being routed to the normalization circuits 111 to 114 associated with the respective frequency bands, as shown in FIG. 5.

Figure 10:
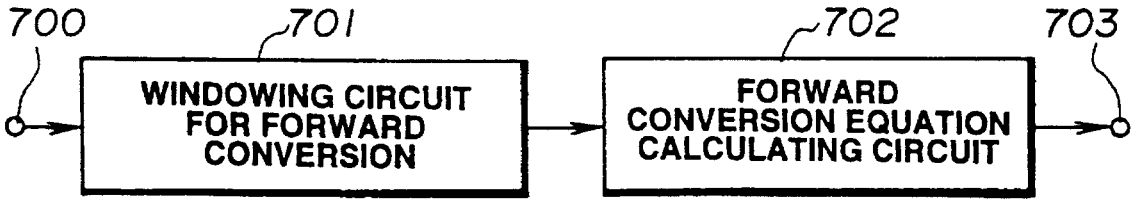
FIG. 10 is a block circuit diagram showing an arrangement of a forward spectrum converting circuit of a frequency dividing circuit for the encoder according to the embodiment shown in FIG. 8.

The forward spectrum conversion circuits 521 to 523, shown in FIG. 9, are specifically arranged as shown in FIG. 10, wherein only one of the spectrum conversion circuit is shown.

Referring to FIG. 10, an output of the frequency dividing filter is routed to a terminal 700 and thence routed to a windowing circuit 701 for forward conversion. The windowing circuit for forward conversion 701 multiplies the input signal with a window function for forward conversion as shown in FIG. 7B.

An output of the windowing circuit 701 is supplied to a forward conversion equation calculating circuit 702 where the signal multiplied with the window for forward conversion is converted into spectral signals. The conversion length is equal for all domains, as explained previously.

Figure 11:
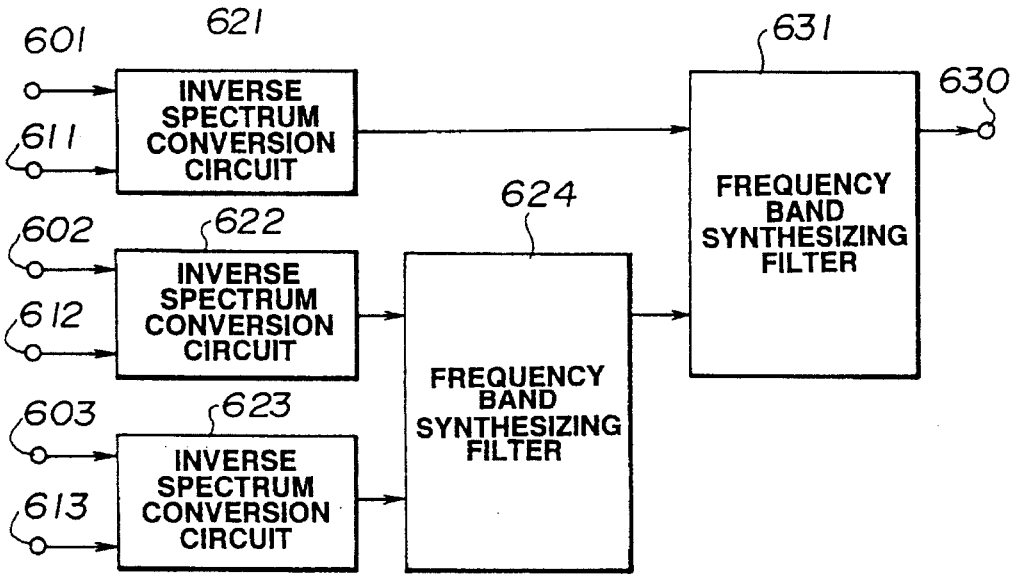
FIG. 11 is a block circuit diagram showing an arrangement of a frequency range synthesizing circuit of a decoding device according to an embodiment of the present invention.

FIG. 11 shows an arrangement of a frequency range synthesizing circuit of a decoding device according to the present invention.

In the pre-stage of inverse spectrum conversion circuits 621, 622 and 623 of the synthesizing circuit, shown in FIG. 11, the code string from the encoding device having the frequency dividing circuit shown in FIG. 5 is divided into respective frequency bands by the demultiplexor 202 of FIG. 6, and signal components are constructed from one frequency band to another by the signal component constructing circuits 211 to 214 shown in FIG. 6. These signal components, which are signal components on the basis of the pre-set frequency bands, such as critical bands, are grouped according to three bands associated with the frequency division by the frequency dividing filter of the frequency dividing circuit.

The suppression control information of the signals of the three frequency bands as the pre-echo information and the information corresponding to the de-normalized and inverse quantized spectral signals are supplied to terminals 601, 602 and 603 and to terminals 611, 612 and 613 of the synthesizing circuit, shown in FIG. 11, respectively.

The above information is routed to associated inverse spectrum conversion circuits 621, 622 and 623 on the band basis. The inverse spectrum conversion circuits 621, 622 and 623 calculate three band signals from the input information. These three-band signals are routed to a dual frequency range synthesizing circuit 624–631.

Outputs of the inverse spectrum conversion circuits 622 and 623 are synthesized by the frequency synthesizing filter 624, while outputs of the inverse spectrum conversion circuit 621 and the frequency synthesizing filter 624 are synthesized by the frequency synthesizing filter 631. This causes band-synthesized audio signals to be produced by the frequency synthesizing filter 631 and outputted at a terminal 630.

Figure 12:
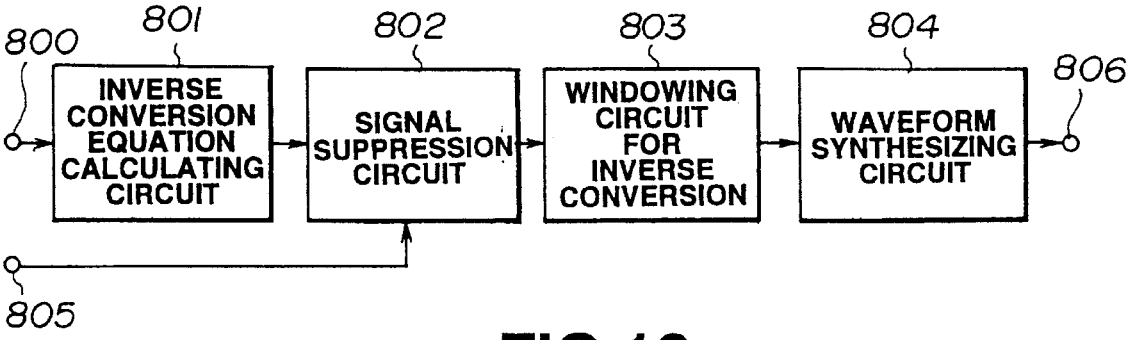
FIG. 12 is a block circuit diagram showing an arrangement of an inverse spectrum conversion circuit of the frequency range synthesizing circuit of the decoding device embodiment of FIG. 11.

In FIG. 12, there is shown an arrangement of one of the inverse spectrum conversion circuits 621, 622 and 623 shown in FIG. 11.

Referring to FIG. 12, the information corresponding to the de-normalized and inverse quantized spectral signals enters a terminal 800, while the above-mentioned suppression control information enters a terminal 805. The information corresponding to the spectral signals is routed to an inverse conversion equation calculating circuit 801 where it is converted into signals on the time axis and thence routed to a signal suppression circuit 802 which is also fed with the above-mentioned suppression control information. The signal suppression circuit 802 suppresses the samples of the information corresponding to the spectral signals liable to pre-echo, based upon the suppression control information, and transmits the resulting signal to a windowing circuit for inverse conversion 803.

The windowing circuit for inverse conversion 803 multiplies the input signals with an inverse conversion window, using the window function for inverse conversion shown in FIG. 7E, and transmits the resulting signal to a waveform synthesizing circuit 804. The waveform synthesizing circuit 804 synthesizes the conversion domain at the current time point and conversion domains temporally preceding and succeeding it, as supplied from the windowing circuit for inverse conversion 803, to produce a synthesized output, which is outputted at a terminal 806.

In the present embodiment, the domain to be set to zero need not be set to a length of the signal suppressing domain from the leading end of the conversion domain. In such case, the start position and the end position of the signal suppressing domain may be transmitted to or recorded on a recording medium. In such case, it is possible to suppress the quantization noise in mid portions or rear portions of the conversion domains where the waveform becomes smaller. However, since the occurrence of the quantization noise raises a problem when there is no signal component of a sufficient amplitude to mask the quantization noise at the same time as or temporally before the quantization noise and hence the noise is heard as the pre-echo. Thus the signal suppressing period may be started from its leading end and only the length of the signal suppressing domain may be encoded thereby improving the efficiency.

For signal suppression, the signal level for the suppression domain may be reduced to a smaller value by multiplication with a pre-set coefficient, instead of reducing the sample values to zero. In such case, a coefficient which does not necessarily assume the value of 0 or 1 may be transmitted, or plural shapes of the signal suppression functions may be set and a code designating one of the signal suppression functions may be transmitted or recorded.

In the present embodiment, description has been made of a case in which the frequency spectrum is pre-divided by a filter and converted into spectral signals, which are encoded. In such case, if high frequency signals are suddenly supplied to sub-stationary signals, it becomes possible to prevent the pre-echo by suppressing only the quantization noise in the high frequency range, thereby achieving encoding with higher fidelity.

It is when the sound signal level for the entire frequency spectrum is changed suddenly that the pre-echo tends to be a hindrance to the acoustic sense. It is therefore occasionally advisable to detect the domain of pre-echo generation for only a pre-set band and to control the signal suppression of the entire frequency spectrum by the same signal suppression control information. This enables the quantity of the signal suppression control information to be reduced.

The present method may also be applied to a case wherein spectrum conversion is performed on signals which are not previously divided into plural frequency ranges by a filter. Although MDCT has been taken as an example of spectrum conversion, spectrum conversion may also be made by discrete Fourier transform (DFT) or discrete cosine transform (DCT). The present method may also be applied to a case wherein the input signals are divided into plural frequency ranges by a filter without employing spectrum conversion and the resulting signals on the time domain are quantized and encoded.

One of the outstanding merits of the present method resides in compatibility with the decoding device employing a fixed conversion length. If the signal coded by the present method is not processed by the decoding device with signal suppression, the resulting signal is the same as the output signal which would be produced when the signal converted by the fixed conversion length and encoded is decoded. Consequently, if the deterioration by the pre-echo, as perceived by the aural sense, is not objectionable, it is possible for the conventional decoding device decoding the signal encoded after conversion with the fixed conversion length to decode the signal encoded by the present method by simply disregarding the signal suppression control information.

The method of the present invention may also be applied to multi-channel audio signals. That is, by employing the method of the present invention, it becomes possible for the user to enjoy multi-channel audio signals of high quality by simple means. In such case, it suffices to encode the signal suppression control information in each channel.

Although the description of the present embodiment has been made with reference to a case of suppressing the range of generation of the quantization noise on quantization of audio waveform signals. The present method may also be applied to, for example, video signals, because it is effective in restricting the range of occurrence of the quantization noise only to those portions where the original signals are larger, thereby rendering these signal less perceptible.

Figure 7F:
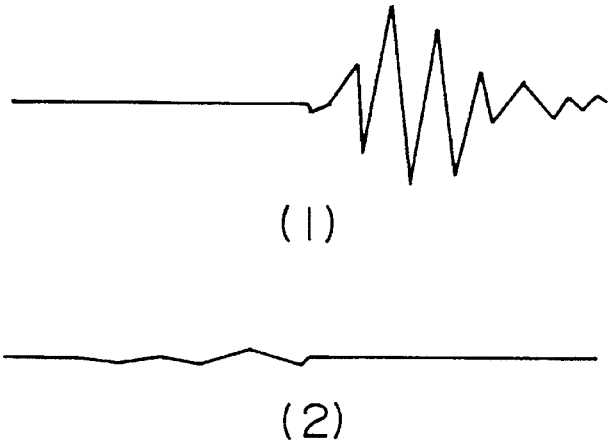

In a second embodiment of the present invention, which is now explained, a signal waveform shown in FIG. 7(C) is divided into two signal waveforms (1) and (2) shown in FIG. 7(F). With the signal waveform (1) and (2) shown in FIG. 7(F), the waveform signal is zero for the sub-domains 1 to 4 and for the sub-domains 5 to 8 of FIG. 7(C), respectively.

These waveform signals are separately converted into spectral signals which are encoded. The encoded signals of the two spectral signals are recorded on a recording medium, as later explained, along with the signal changeover information, which in this case is the pre-echo information indicating that the waveform signal is changed over directly after the fourth sub-domain. The decoding device generates a synthesized waveform in which waveform signals inverse-converted from the spectrum of the waveform signal (2) of FIG. 7(F) are assumed for the first to fourth sub-domains of FIG. 7(C) and waveform signals inverse-converted from the spectrum of the waveform signal (1) of FIG. 7(F) are assumed for the fifth to eighth sub-domains of FIG. 7(C).

In such case, the quantization noise generated during the first to fourth sub-domains of FIG. 7(C) is generated on quantization of the waveform signal (2) of FIG. 7(F). However, since the signal waveform (2) of FIG. 7(F) is inherently low in signal level, the quantization noise level may be lowered to a level of being masked by the original signal level, with a smaller number of quantizing bits, if the signal waveform (2) is normalized before quantization, thereby preventing the hindrance to the acoustic sense by the pre-echo.

In the present example, it is assumed that the waveform signal (1) of FIG. 7(F) has a value of 0 for the first to fourth sub-domains. If the signal value for the first to fourth sub-domains is sufficiently small as compared to the signal value for the fifth to eighth sub-domains, the quantization noise which is generated for the fifth to eighth sub-domains on spectrum conversion and quantization is sufficiently small. It is therefore possible for the waveform signal (1) shown in FIG. 7(F) to be the waveform signal itself shown in FIG. 7(C). Similarly, the waveform signal (2) of FIG. 7(F) need not necessarily be set to 0 for the fifth to eighth sub-domains, if only the signal is suppressed to a sufficiently small value as compared to that of the first to fourth sub-domains.

As for the method of changing over the signals, it suffices if the two waveform signals are changed over at a time point as indicated by the changeover information. Alternatively, the two signals may also be weighted and summed.

The processing operation of finding the duration N of the domain of pre-echo for the second embodiment is the same as that for the first embodiment as explained in connection with FIG. 8.

The duration N of the pre-echo domain is supplied from the encoding device to the decoding device as the signal changeover information for preventing the pre-echo, that is the pre-echo information.

The number of samples up to the changeover point may also be employed as the signal changeover information instead of the number of the sub-domains. However, if the duration of pre-echo is sufficiently short, the pre-echo may be prevented from becoming the hindrance to the aural sense by the above-mentioned backward masking. It is therefore more effective to record the information by the number of the sub-domains for improving the coding efficiency.

Figure 13:
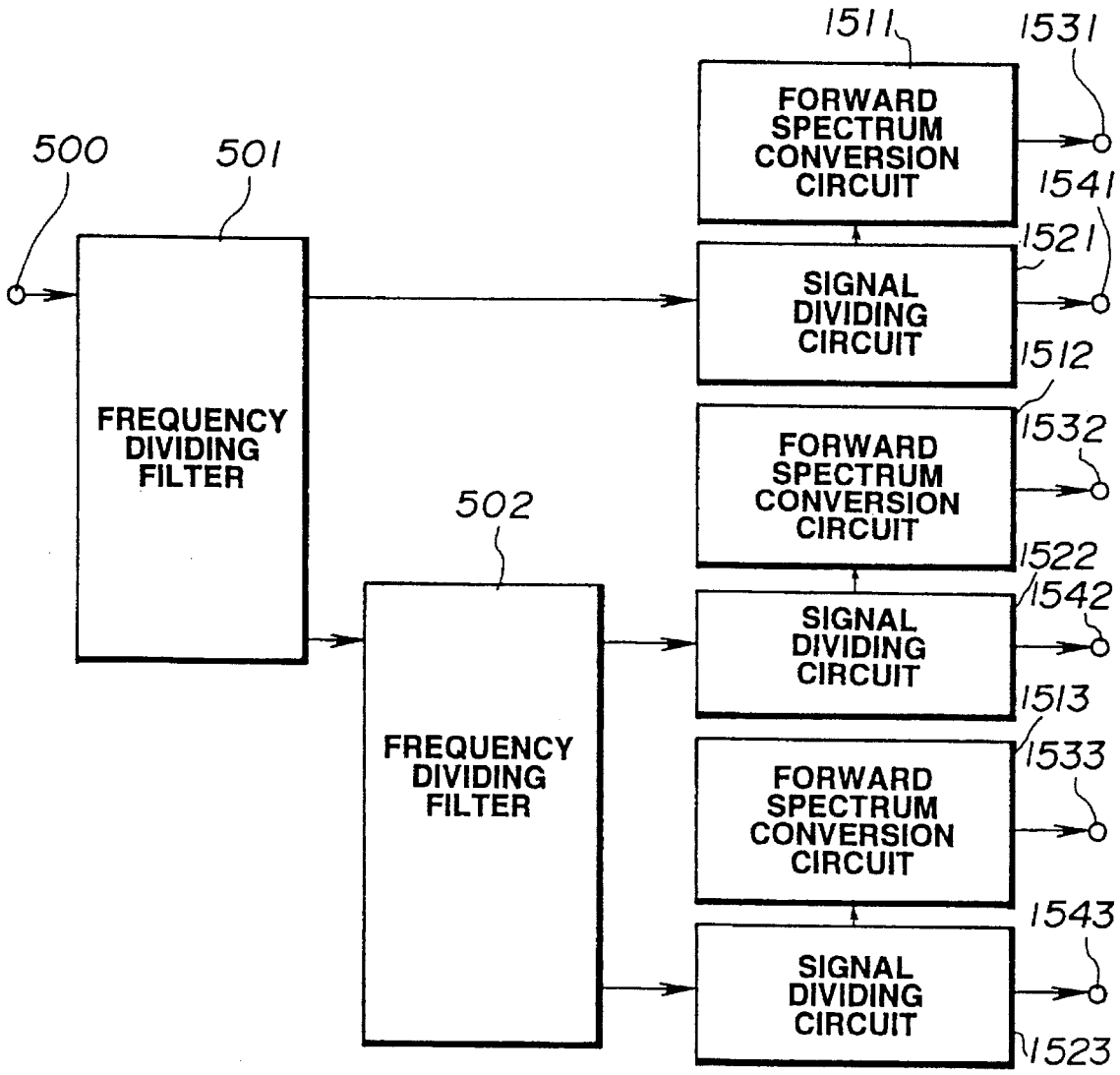
FIG. 13 is a block circuit diagram showing an arrangement of a frequency dividing unit for the encoding device according to first and second embodiments of the present invention.

FIG. 13 shows an arrangement of a frequency dividing circuit for the encoding device according to the second embodiment of the present invention.

Referring to FIG. 13, showing an arrangement of the frequency range dividing circuit 101 shown in FIG. 5, input audio signals are supplied from the terminal 100 of FIG. 5 and routed to a pre-stage frequency dividing filter 501 of a dual-stage frequency dividing filter 501–502. One of the frequency bands divided from a frequency spectrum by the filter 501 is supplied to the filter 502 which further divides the frequency of the signals supplied from the filter 501. Thus the input audio signal supplied to the terminal 500 is divided by the frequency dividing filters 501, 502 into three frequency ranges.

The frequency band signals from the frequency dividing filters 501, 502 are routed to signal dividing sections 1521, 1522 and 1523 associated with the respective frequency ranges, and thereby divided into a temporally forward section and a temporally trailing section at a position as found by the above-mentioned method.

The temporally forward and the temporally trailing signal sections, as divided by the signal dividing circuits 1521, 1522 and 1523, are routed to associated forward spectrum conversion circuits 1511, 1512 and 1523 where they are converted to spectral signals. The forward spectrum conversion circuits 1511 to 1523 may be implemented by, for example, the above-mentioned MDCT.

The signal changeover information (pre-echo information) from the signal dividing circuits 1511 to 1513 and the spectral signals from the conversion circuits 1511 to 1513 are outputted via output terminals 1541 to 1543 and via output terminals 1531 to 1533, respectively, and grouped according to pre-set frequency bands so as to be supplied to, above all, the normalization circuits 111, 112, 113 and 114 associated with the respective frequency bands.

Figure 14:
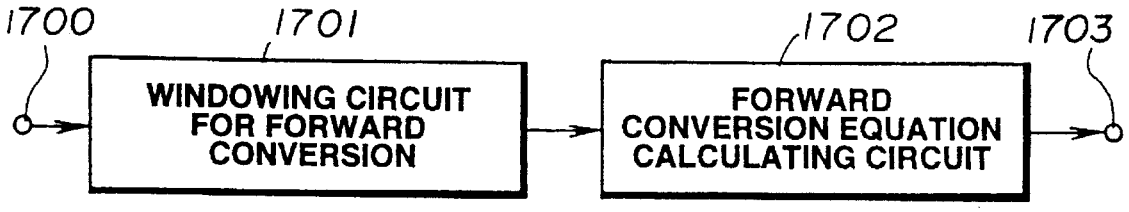
FIG. 14 is a block circuit diagram showing an arrangement of a forward spectrum conversion circuit of a frequency dividing circuit of the encoding device according to first and second embodiments.

The forward spectrum conversion circuits 1511 to 1513 shown in FIG. 13 is arranged as shown in FIG. 14, wherein only one of the spectrum conversion circuits is shown.

Referring to FIG. 14, an output of the associated signal dividing circuit is supplied to a terminal 1700 and thence supplied to a windowing circuit 1701 for forward conversion where the input signal is multiplied with a window function for forward conversion as shown in FIG. 7(B).

An output of the windowing circuit for forward conversion 1701 is supplied to a forward conversion equation calculating circuit 1702. The signal thus multiplied with the window for forward conversion is converted into a spectral signal. In this case, the same conversion length is used for all domains, as explained previously.

These forward spectrum converting circuits perform forward spectrum conversion twice in each block, in association with the signal waveforms (1) and (2) of FIG. 7(D). However, if the waveform signal is not changed acutely in the sub-stationary portion, only one spectrum converting operation suffices.

Figure 15:
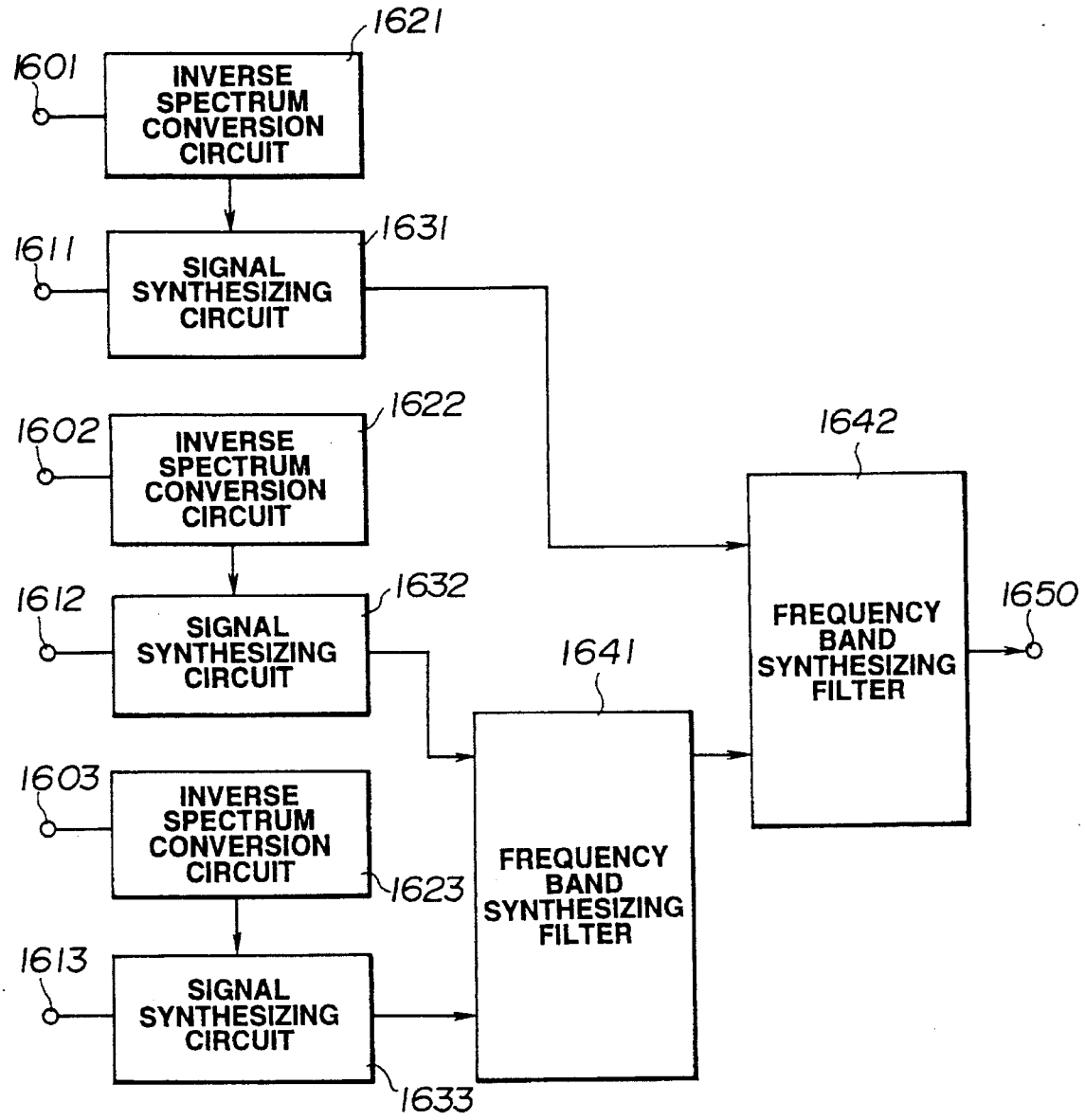
FIG. 15 is a block circuit diagram showing an arrangement of a frequency range synthesizing circuit of the decoding device according to the first embodiment.

FIG. 15 shows an arrangement of a frequency range synthesizing circuit for the decoding device for the present embodiment.

In the pre-stage of inverse spectrum conversion circuits 1621, 622 and 1623 of the synthesizing circuit, shown in FIG. 15, the code string from the encoding device having the frequency dividing circuit shown in FIG. 5 is divided into respective frequency ranges by the demultiplexor 202 of FIG. 6, and signal components are constructed on the band basis by the signal component constructing circuits 211 to 214 shown in FIG. 6. These signal components are signal components on the basis of the pre-set frequency band.

To terminals 1601, 1602 and 1603 of the frequency band synthesizing circuit shown in FIG. 15, there are supplied signals produced by processing spectral signals at the terminals 1531, 1532 and 1533 of FIG. 13 by the downstream side stage of the frequency dividing circuit 101 of FIG. 5, that is the normalized and quantized spectral signals, normalization coefficient information and the quantization resolution information.

These spectral signals are routed to the inverse spectrum conversion circuits 1621, 1622 and 1623 associated with the respective frequency bands. The inverse spectrum conversion circuits 1621, 1622 and 1623 convert the two kinds of the spectral information associated with the waveforms (1) and (2) of FIG. 7D into time-domain waveform signals. The waveform signals, produced by inverse spectral conversion, are routed to associated signal synthesizing circuits 1631, 1632 and 1633.

The signal changeover information from the signal component constructing circuits of FIG. 6 is supplied to terminals 1611, 1612 and 1613 and thence supplied to the associated signal synthesizing circuits 1631 to 1633, where three band signals are synthesized from the signal changeover information supplied from the terminals 1611 to 1613 and the waveform signals converted by the inverse spectral conversion from the inverse spectrum conversion circuits 1621 to 1623. These three band signals are routed to dual band synthesizing filters 1641 and 1642.

Outputs of the signal synthesizing circuits 1632 and 1633 are synthesized by the frequency band synthesizing filter 1641. Outputs of the signal synthesizing circuit 1631 and the frequency range synthesizing filter 1641 are synthesized by the frequency range synthesizing filter 1642. In this manner, band-synthesized audio signals are produced by the frequency range synthesizing filter 1641 and outputted at a terminal 1650.

Figure 16:
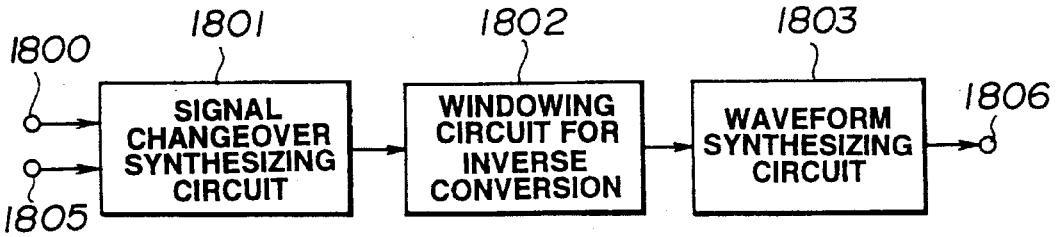
FIG. 16 is a block circuit diagram showing an arrangement of an inverse spectrum conversion circuit of the frequency range synthesizing circuit of the decoding device according to the first embodiment.

In FIG. 16, there is shown an arrangement of one of the signal synthesizing circuits 1631 , 1632 and 1633.

Referring to FIG. 16, the two kinds of the spectral information, associated with the waveforms (1) and (2) of FIG. 7(D), are converted by the inverse spectrum converting circuit into time-domain waveform signals which are supplied to a terminal 1800 of FIG. 16. These waveform signals are synthesized by a signal changeover synthesizing circuit 1801, based upon the signal changeover information supplied via the terminal 1800, and the resulting synthesized waveform signal is supplied to a windowing circuit for inverse conversion 1802.

The synthesized waveform signal is multiplied by the windowing circuit for inverse conversion 1802 with an inverse conversion window shown in FIG. 7(B) before being supplied to a waveform synthesizing circuit 1803 in which the conversion domain at the current time point and the conversion domains temporally preceding and succeeding it are synthesized. The resulting synthesized signal is outputted at a terminal 1806.

Figure 17:
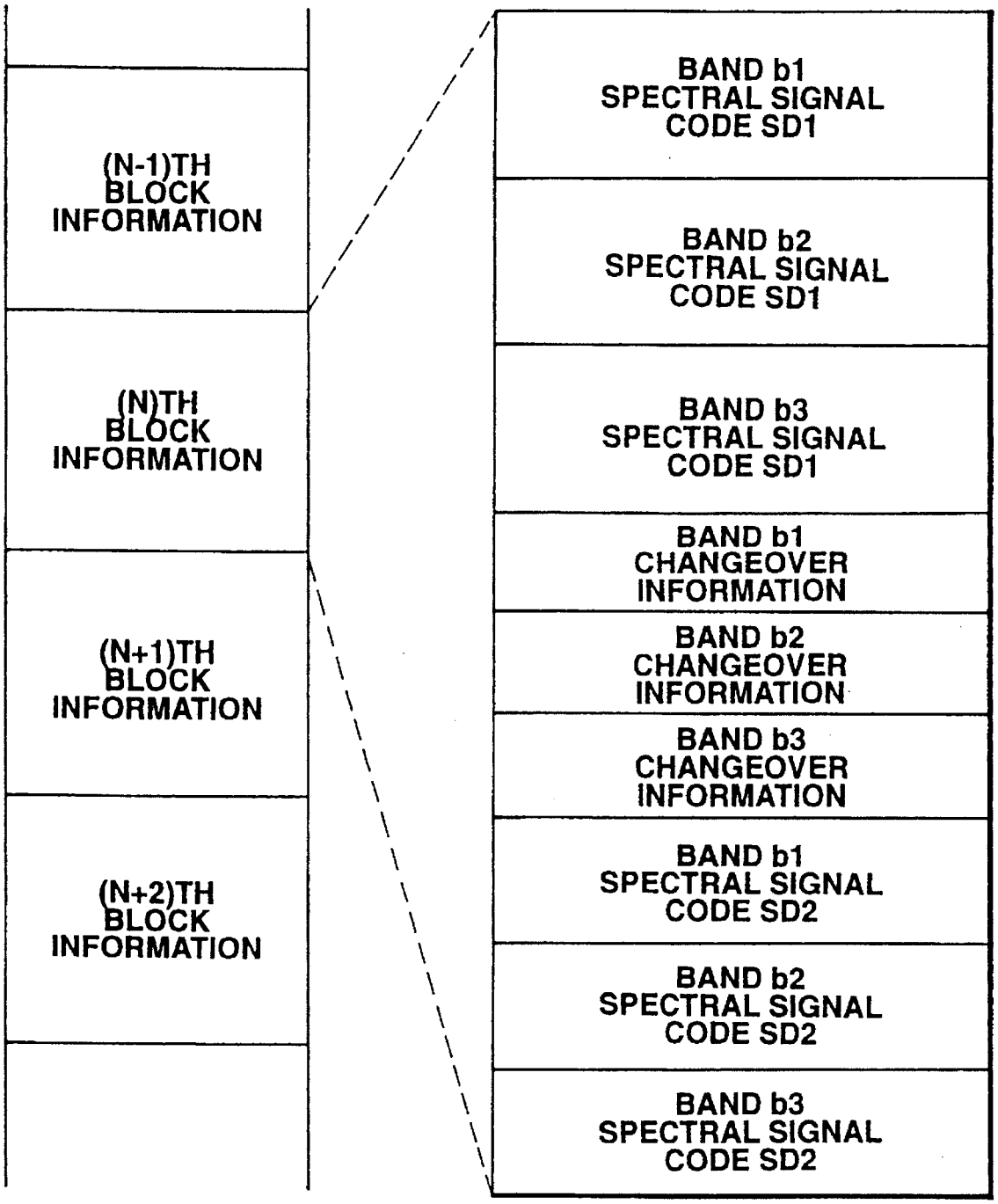
FIG. 17 illustrates the recording method for signals encoded by the encoding device of the first embodiment.

Referring to FIG. 17, the method of recording the code data produced by the information encoding device of the embodiment illustrated on a recording medium is hereinafter explained.

In the example of FIG. 17, the spectral information of the bands b1 to b3 prior to changeover (spectral signal code SD1) is first recorded, followed by the changeover information for the bands b1 to b3 and by the spectral information posterior to changeover (spectral signal code SD2), in this order.

The number of sub-domains prior to changeover, as shown in FIG. 7(C), may be recorded as the changeover information. If the changeover information is zero, it is unnecessary to perform the operation of changing over and synthesizing the signal waveforms, in which case the recording of the spectral information prior to changeover may be omitted.

One of the significant advantages of the second embodiment of the present invention is the compatibility with the decoding device employing the fixed conversion length. If, with respect to the data encoded by the encoding method according to the second embodiment, decoding of the waveform signal for preventing the occurrence of the pre-echo corresponding to FIG. 7(D) is not made by the decoding device, reproduction may be made with acceptable sound quality despite the occurrence of the pre-echo. Consequently, if the deterioration in the psychoacoustic sound quality due to the pre-echo is not objectionable, the data encoded by the method of the embodiment illustrated may be decoded by a decoding device decoding the code data converted by the conventional fixed conversion length by simply disregarding the information recorded after the "changeover information for the band b1" shown in FIG. 17.

The waveform signal separation may also be made not only when the signal waveform is acutely increased, but also when the signal waveform is suddenly decreased. This enables the quantization noise to be diminished in the portion in which the signal is deceased. The number of waveform signals separated from a signal waveform may be three or more instead of two as in the previous embodiment.

Although the description of the second embodiment has been made with reference to a case in which signals divided in frequency by a filter and converted into spectral signals are encoded, the present method may also be applied to a case in which the signals not divided in frequency by a filter are converted into spectral data. However, if the signals are divided in frequency by a filter, it becomes advantageously possible to change the contents of the changeover information on the band basis and to effect the forward and inverse spectral conversion a plural number of times only in necessary bands. If, for example, attack portions of a signal having large high frequency components are superposed on sub-stationary signals, the signal processing quantity may be diminished by carrying out the forward and inverse spectral conversion a plural number of times in only the high frequency ranges.

Although the description has been made with reference to MDCT as an example of spectral conversion, discrete Fourier transform (DFT) or discrete cosine transform (DCT) may also be employed. The present method may also be applied to a case in which, instead of employing special spectrum conversion, the input signal is divided in frequency by a filter into band signals, which are then quantized and encoded. The frequency components obtained by such filter in the description of the present invention are also termed the spectral signals.

The method of the second embodiment of the present invention may also be applied to multi-channel signals so that high quality multi-channel audio signals may be produced by simple means.

Although the above description has been made with reference to a case in which the quantization noise produced on quantizing audio waveform signals is rendered less perceptible, the present method is also effective in rendering the quantization noise of other kinds of signals less perceptible and may also be applied to, for example, picture signals.

A third embodiment of the present invention is now explained.

In the following description, only the portions of the present embodiment different from the second embodiment are explained for avoiding redundancy.

With the present method of the third embodiment, the concept of the second embodiment is used for a particular band and the concept of the first embodiment is used for bands other than the particular band. That is, for bands other than the particular band, instead of changing over and synthesizing the two waveform signals, the pre-echo produced is forcefully suppressed, thereby diminishing the quantity of the encoded data and hence the data processing quantity of the encoding and decoding devices. For forcefully suppressing the pre-echo, it is possible to reduce the waveform signal data directly before the acute increase of the waveform signal to zero. Alternatively, the signal may be multiplied by a sufficiently small weighting coefficient for signal suppression.

As a particular band in which two waveform signals are changed over and synthesized, such a band may be selected in which the signal energy becomes maximum up to a time point of rapid signal level increase. Since the low-range signals are dominant in the ordinary audio signals, it is also possible to change over and synthesize two waveform signals only in the low frequency range. If the pre-echo generated in the range other than the particular range is forcefully suppressed, the waveform signal may be increased slightly in distortion or become narrower in the frequency range. However, this is not particularly objectionable to the aural sense because such processing is performed only for a brief time interval previous to the attack portion.

Figure 18A:
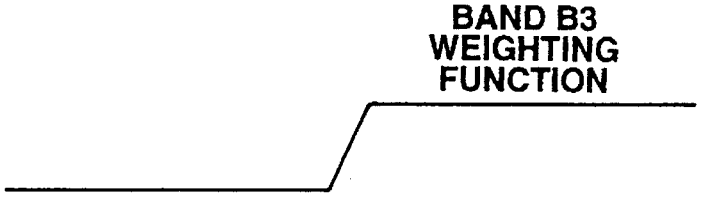
FIGS. 18(A) through 18(C) illustrate an example of a weighting function for the second embodiment.
Figure 18B:
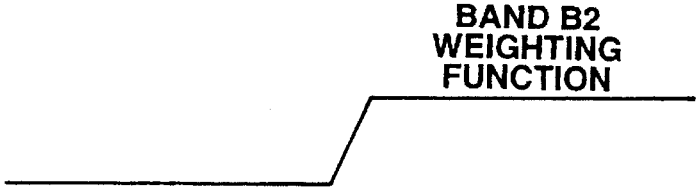
Figure 18C:
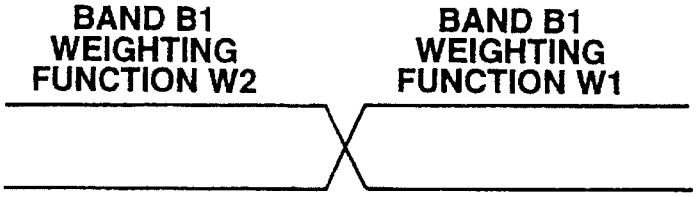

FIGS. 18(A), 18(B) and 18(C) show examples of weighting functions which may be used for signal waveform changeover and suppression in the decoding device of the present embodiment. FIGS. 18(A), 18(B) and 18(C) show a weighting function for the band b3, a weighting function for the band b2 and weighting functions W2, W1 for the band b1, respectively. That is, in the present example, two signal waveforms are changed over and synthesized only for the band b1, while signals are suppressed in pre-echo regions for the bands b2 and b3.

Figure 19A:
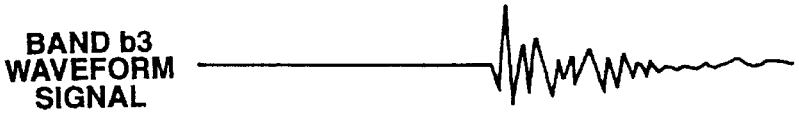
FIGS. 19(A) through 19(C) illustrate an example of signals processed by encoding and decoding according to the second embodiment.
Figure 19B:
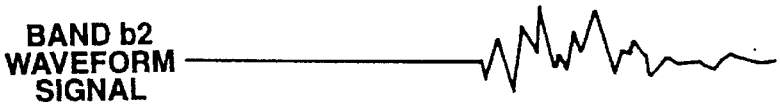
Figure 19C:
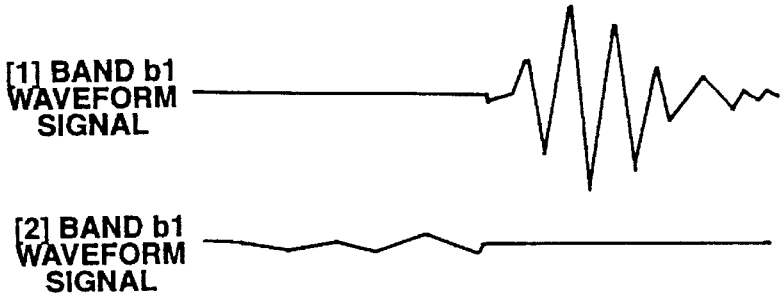

FIGS. 19(A), 19(B) and 19(C) show the states of four waveform signals after application of the weighting functions of FIGS. 18(A), 18(B) and 18(C) in the decoding device. FIGS. 19(A), 19(B), 19(C)[1] and [2] show the waveform signals b3, b2, b1 and b2 waveform signals, respectively. In the present example, these four waveform signals are synthesized to produce ultimate waveform signals.

In the third embodiment, a processing operation for finding the duration N of the pre-echo domain is carried out in a similar manner as shown in FIG. 8. Such processing operation for the present embodiment may be performed before frequency division in the encoding device in order to produce a common changeover signal for each band, or for each band after frequency division.

Alternatively, the processing operation may be performed for each band as shown in FIG. 8 and a band in which there is the maximum value of $P_0$ may be adopted as being a band in which two waveform signals are changed over and synthesized.

Figure 20:
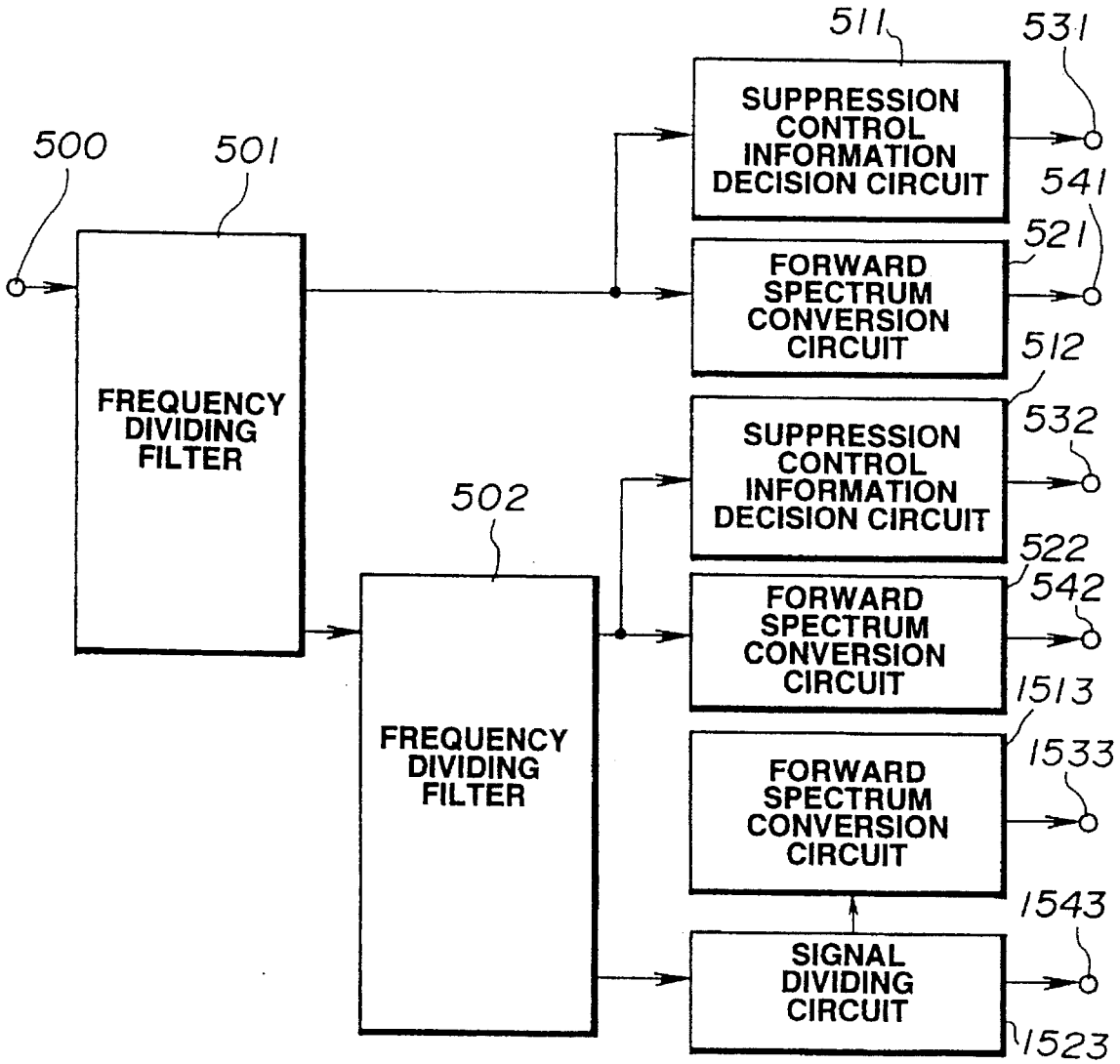
FIG. 20 is a block circuit diagram showing an arrangement of a frequency dividing circuit for an encoding device according to a second embodiment of the present invention.

FIG. 20 shows an arrangement of the frequency dividing circuit 101 for the third embodiment. The contents of the blocks are not explained in detail because these blocks are the same as the blocks bearing the same numbers in FIGS. 9 and 13. In the present example, only the signals of the band b1 are synthesized so that the waveform signals are changed over, whereas, for the remaining bands, the waveform signals are suppressed by the decoding device in the pre-echo producing region.

The forward spectral conversion circuit 1513 in FIG. 20 performs forward spectral conversion twice for one block, if the sound undergoes sudden changes, while the forward spectral conversion circuits 1521, 1522 perform a forward spectral conversion for one block. If the waveform signal is not changed acutely in its sub-stationary portion, it is sufficient to perform one forward spectral conversion for each band.

Figure 21:
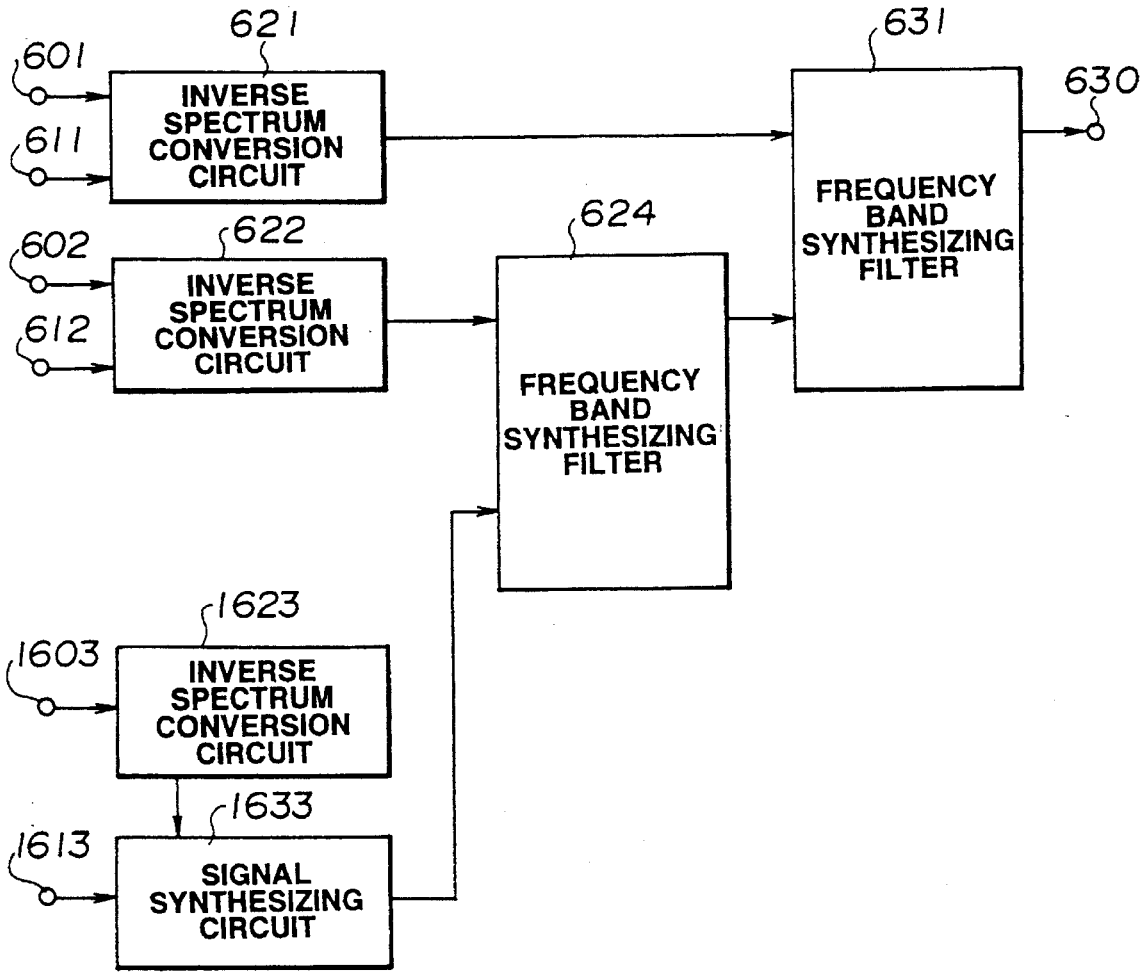
FIG. 21 is a block circuit diagram showing an arrangement of a frequency range synthesizing circuit of a decoding device according to the second embodiment of the present invention.

FIG. 21 shows an arrangement of a frequency band synthesizing circuit 221 for the third embodiment. The contents of the blocks are not explained in detail because these blocks are the same as the blocks bearing the same numbers in FIGS. 11 and 15.

If, in the present embodiment, the band in which plural waveform signals are changed over for synthesis is not pre-set, it is also possible to provide a signal changeover and synthesis/suppression circuit, having both the function of signal changeover and synthesis and the function of signal changeover and suppression, for each band, and to control the signal changeover and synthesis/suppression circuit based upon the code information indicating in which band to perform changeover/synthesis or and in which band to perform changeover/suppression.

Figure 22:
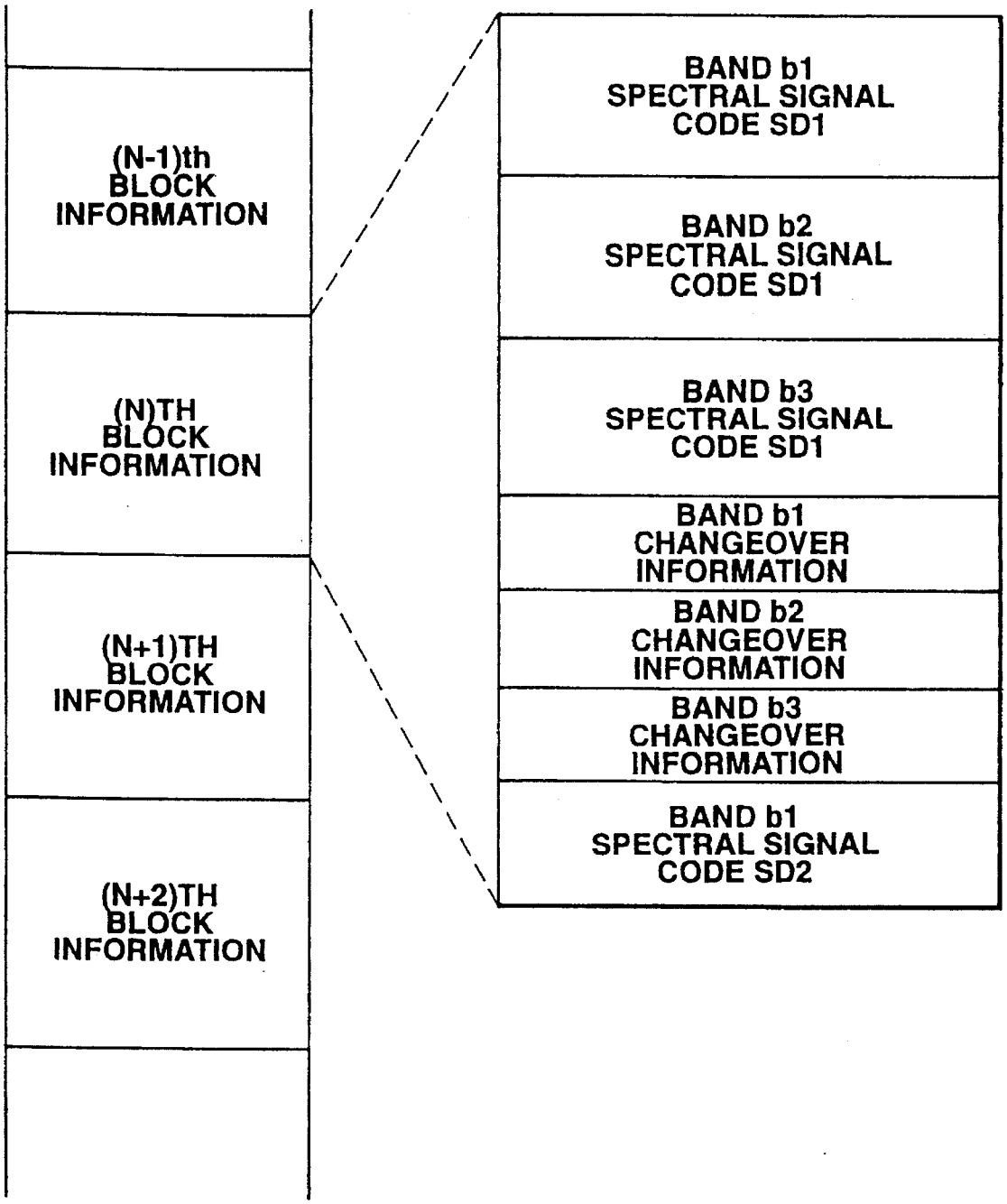
FIG. 22 illustrates an example of a recording method for signals encoded by the encoding method of the second embodiment.

FIG. 22 shows an embodiment of the recording method for recording the code data obtained by coding by the device of the third embodiment.

In the present example, the spectral information for the bands b1 and b2 after the changeover (spectral signal code SD1) is recorded and subsequently the changeover information for the bands b1 and b2 is recorded. Finally, the spectral information prior to changeover (spectral signal code SD2) is recorded.

In the present third embodiment, the number of subdomains in FIG. 7(C) prior to changeover may be recorded as the changeover information. The changeover information equal to 0 indicates that it is unnecessary to change over and synthesize the signal waveforms, in which case the recording of the spectral information prior to changeover may be omitted. In the present example, the band in which plural waveform signals are synthesized so as to be changed over is fixed as being the band b1.

Figure 23:
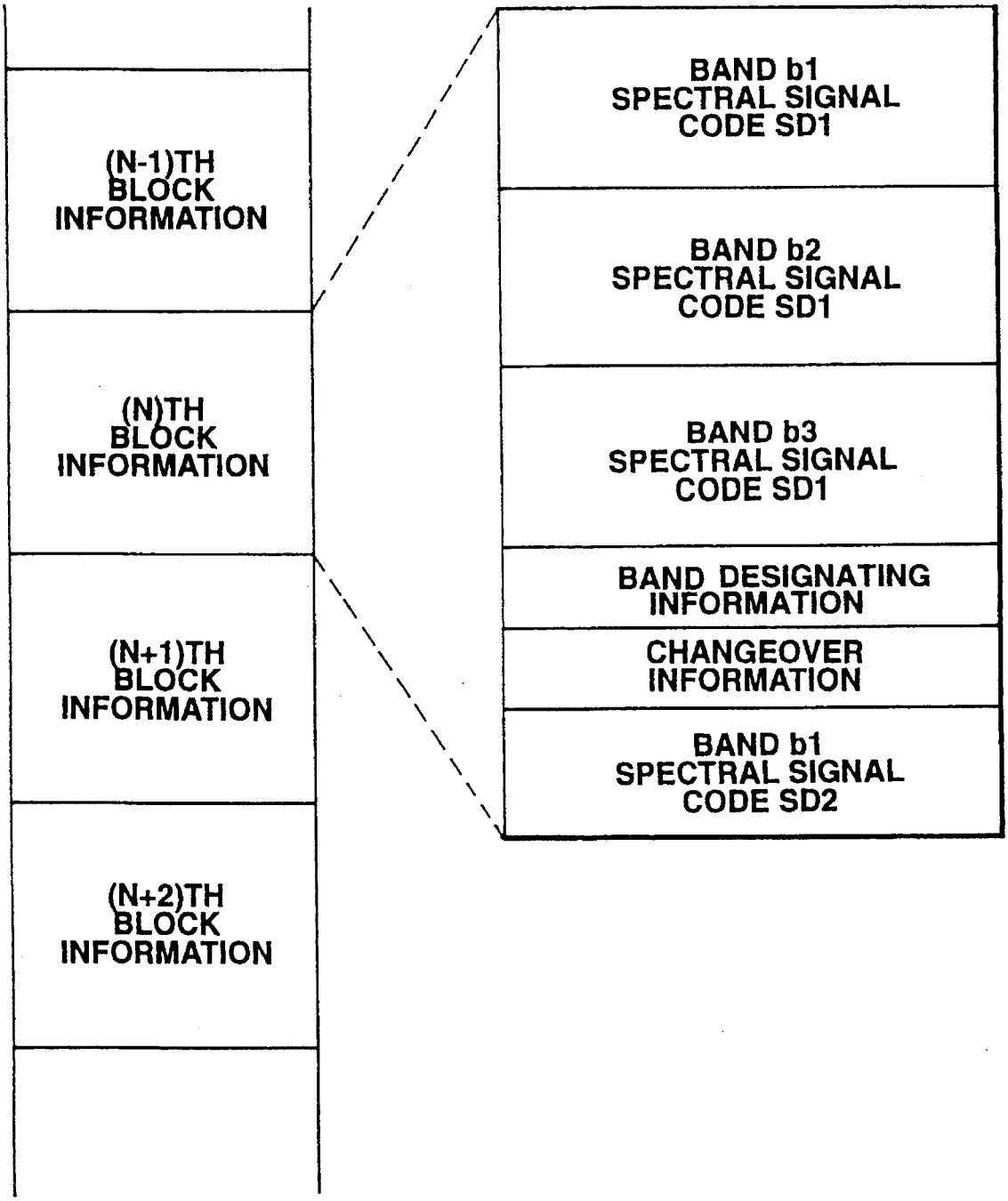
FIG. 23 illustrates another example of the recording method for signals encoded by the encoding method according to the second embodiment.

FIG. 23 shows an illustrative another recording method for code data obtained by encoding in accordance with the method of the present third embodiment.

In the present embodiment, the band in which plural waveform signals are synthesized so as to be changed over is not fixed and is designated by the band designating information. Also, in the present embodiment, only one changeover information, which is common to the respective bands, is recorded, and the changeover/synthesis or changeover/suppression for signal waveforms is carried out for each band based upon the band designating information. In the present embodiment, the band b1 is designated by the band designating information as being a sole band in which signal waveform changeover/synthesis is to be performed.

One of the significant advantages of the third embodiment of the present invention is the compatibility with the decoding device employing the fixed conversion length. If, with respect to the data encoded by the encoding method according to the second embodiment, decoding of the waveform signal for pre-echo prevention corresponding to (2) of FIG. 7(D) is not made by the decoding device, reproduction may be made with acceptable sound quality even although pre-echo is produced. Consequently, if the deterioration in the psychoacoustic sound quality due to the pre-echo is not objectionable, it is possible for the decoding device decoding the code data converted by the conventional fixed conversion length to decode the data encoded by the method of the embodiment illustrated by simply disregarding the information recorded after the "changeover information for the band b1" shown in FIG. 22.

It is also possible to record two kinds of the spectral information in each band for a block where the signal is increased acutely in intensity and to change over and synthesize the signal waveform only in the band b1 while suppressing the signal waveform in the other bands. If a high quality decoding device capable of changing over and synthesizing signal waveforms in each band is introduced in future, it becomes possible to realize signal decoding of higher fidelity using the same recording information.

The decoding device itself may be designed to give a decision as to in which band the signal waveform is to be changed over and synthesized. For example, signal changeover and synthesis may be adapted to be performed only in a band assuming the maximum value of the normalization coefficients of the spectrum constituting the temporally previous waveform signal.

Waveform signal separation may be effected when the signal waveform becomes acutely small instead of when the signal waveform is acutely increased. This allows the quantization in the decreased signal portion to be reduced. The number of waveform signals may be larger than two, while the number of bands in which to effect signal waveform changeover and synthesis may be two or larger.

Although MDCT is taken herein as an example of the spectral conversion, discrete Fourier transform (DFT) or discrete cosine transform (DCT) may also be employed. It is unnecessary to use special processing techniques, such as fast Fourier transform, as the method for spectral calculations. For the purpose of the present invention, it is only sufficient if resolution into frequency components may be achieved to a practically satisfactory level, without regard to the method of carrying out the calculations.

The above description of the third embodiment has been made in connection with a case of lowering the quantization noise in case of quantization of the audio waveform signals to an imperceptible level. The present method is also effective in reducing the quantization noise of other signal types to an imperceptible level and may be applied to, for example, picture signals.

It is seen from above that, with the method of the present invention, the pre-echo may be prevented without rendering the conversion domain length variable and to simplify the arrangement of the coding and encoding devices.

Since the conversion domain length may be increased, sufficient frequency resolution may be achieved. Above all, high efficiency signal compression may be achieved in which the sufficient sound quality is maintained at the sub-stationary waveform portion.

Besides, an acceptable sound quality may be achieved, if such decoding device is used in which inverse spectral conversion is performed only once, even although pre-echo is produced, such that plural decoding devices suited to particular applications may be used simultaneously while compatibility among the various devices is maintained.

Since it is in a particular band that spectral conversion and inverse spectral conversion are executed a plural number of times, the amount of processing operations by the encoding device and by the decoding device is decreased. In addition, a smaller amount of the recorded spectral information suffices so that high efficiency compression may be achieved.

Furthermore, an acceptable sound quality may be achieved, if such decoding device is used in which inverse spectral conversion is performed only once in all bands, even although pre-echo is produced, such that plural decoding devices suited to particular applications may be used simultaneously while compatibility among the various devices is maintained.

Figure 7G:
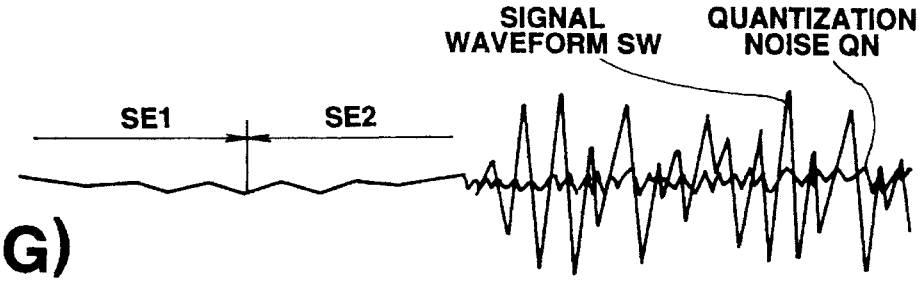

Referring to FIG. 7(G), the principle of the method of preventing the pre-echo in the information decoding according to a fourth embodiment of the present invention is now explained.

For decoding, an output sign waveform of a domain SE2, for which the pre-echo is produced for the output waveform SW of FIG. 7(G), is replaced by a signal modified from a signal waveform for a domain SE1, as shown in FIG. 7(G).

That is, the signal waveform SW for the domain SE1, temporally reversed about the time axis, is used as the signal waveform SW for the domain SE2 (pre-set domain). Since the domain SE2 is of a short duration, on the order of tens of milliseconds, there is only little psychoacoustically alien feeling if the frequency components are not significantly different from those of the original signals. By connecting two signal waveforms which are mirror images of each other with respect to the horizontal time axis, the signal waveforms SW for the domains SE1 and SE2 are connected in continuation of each other so that there is no jerky noise due to the pre-echo in the reproduced sound.

There are various methods, other than that described above, for connecting the signal waveforms of a given domain in continuation to another. For example, the latter half portion of the domain SE1 may be folded and repeated twice. Alternatively, a domain delimited between two points or samples having the waveform signal magnitudes equal approximately to zero may be sliced and the thus sliced domain may be repeated a desired number of times. Such domain is preferably set so as to be an integer number times of the basic wavelength of the audio signal for optimum approximation to the original audio signals. In such case, the pre-set domain is the latter half of the domain SE1 or the domain between the two points or samples. These domains folded and inverted or repeated a desired number of times may be used in place of the pre-set domain SE2.

For determining the length of the pre-set domain SE2, the waveform signal is scanned by the encoding device for finding the maximum value for each of the first to eighth sub-domains as shown in FIG. 7(C), and the sub-domain in which the absolute value is increased suddenly is specified as the pre-set domain. In the example of FIG. 7(C), the sub-domains 1 to 4 are pre-set as being the domains in which the pre-echo is produced.

The processing flow for finding the length N of the domain subject to occurrence of the pre-echo is the same as that shown in FIG. 8 for the first embodiment.

The length N of the domain of occurrence of the pre-echo thus found is sent from the encoding device to the decoding device as the division point information for pre-echo prevention, that is as the pre-echo information.

That is, the domain subject to occurrence of the pre-echo preceding the attack portion experiencing acute signal changes represents the pre-set domain SE2. The length N from the attack portion to the position where the pre-echo ceases to be produced represents the division point information. By sending the division point information to the decoding device, it is possible for the decoding device to replace the domain SE2 with another domain which is modified from the domain SE1.

The method of detecting the attack portion also includes a case in which the length of the sub-domain is set to unity (1), that is to a sample unit. That is, the number of samples up to the division time point, that is a changeover time point, may be used as the division point information, instead of the number of the sub-domains. However, if the period of pre-echo occurrence is sufficiently short, the psychoacoustic hindrance may be eliminated by the above-mentioned inverse masking, so that it is more preferred to record the information with the number of sub-domains for improving the encoding efficiency.

Figure 24:
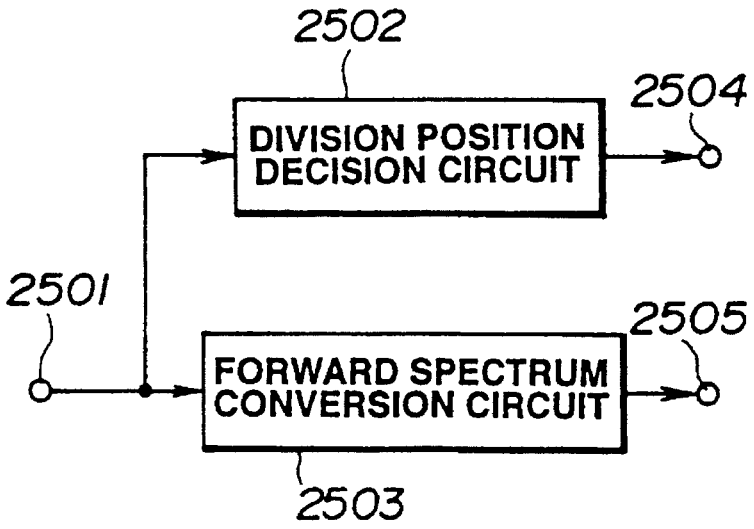
FIG. 24 is a block circuit diagram of the frequency dividing circuit 101 of the embodiment shown in FIG. 5.

In FIG. 24, there is shown an arrangement of a frequency dividing circuit for the encoding device of the present embodiment, having the function of determining the division position.

Referring to FIG. 24, showing an arrangement of the frequency dividing circuit 101 of FIG. 5, the waveform signal corresponding to input signal from the input terminal 100 of FIG. 5 is supplied to a dividing position decision circuit 2502 and to a forward spectral converting circuit 2503. In accordance with the procedure shown in FIG. 8, the dividing position decision circuit 2502 detects a position at which the signal level is increased acutely, and outputs the detected position as the dividing position information at a terminal 2504. The detection output from the terminal 2504, that is the dividing position information, is sent via the multiplexor 131 to the decoding device or recorded on the recording medium as a portion of an output signal from the output terminal 103.

The forward spectrum converting circuit 503 performs spectrum conversion, such as DCT, on the waveform signal from the terminal 2501, using the fixed conversion block length. The spectrum converted signals are routed via a terminal 2505 to a downstream side device. That is, the spectrum converted signal is sent via the multiplexor 131 of FIG. 5, as a part of the output signal of the output terminal 103, to the decoding device, or is recorded on a recording medium.

Figure 25:
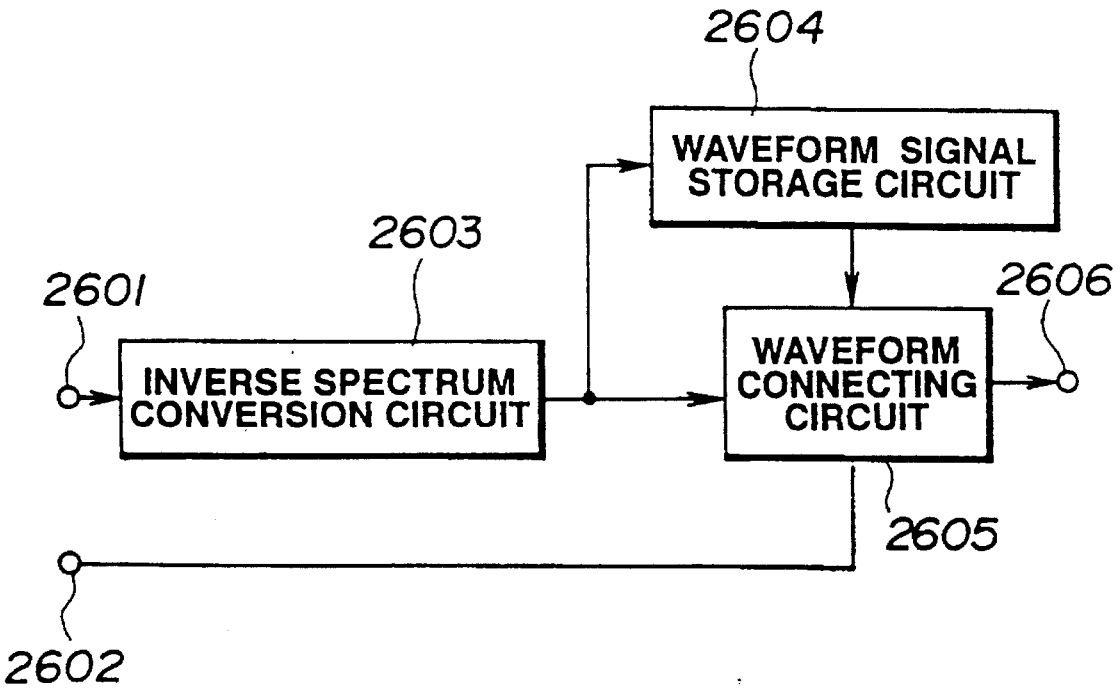
FIG. 25 is a block circuit diagram of a portion of the frequency band synthesizing circuit 221 shown in FIG. 6.

The arrangement on the side of the decoding device, associated with the arrangement of FIG. 24, is shown in FIG. 25. That is, the arrangement of FIG. 25 is built into the frequency band synthesizing circuit 221 on the side of the decoding device shown in FIG. 6.

Referring to FIG. 25, spectral signals from the signal component constructing circuits 211 to 214 of the decoding device of FIG. 6 are supplied to a terminal 2601. The dividing position information, that is an output signal of the terminal 2504 of FIG. 24, is supplied from the demultiplexor 202 of FIG. 6 to a terminal 2602. The spectral signals from the terminal 2601 are processed by an inverse spectrum conversion circuit 2603 with inverse spectrum conversion, a counterpart operation of the spectrum conversion performed by the forward spectrum conversion circuit 2503 of FIG. 24, and are supplied thence to a waveform signal storage circuit 2604 for storage therein, while being also supplied to a waveform connecting circuit 2605.

The waveform connecting circuit 2605 exchanges the output of the inverse spectrum conversion circuit 2603 with a waveform signal of a temporally preceding block (domain) stored in the waveform signal storage circuit 2604 and inverted with respect to the time axis, based upon the dividing position information from the terminal 2602, on the time axis, by way of performing the changeover operation, and connects the output of the circuit 2603 to the inverted signal. The waveform signal storage circuit 2604 is employed for transiently storing the waveform signal of the temporally preceding block or domain.

Figure 26:
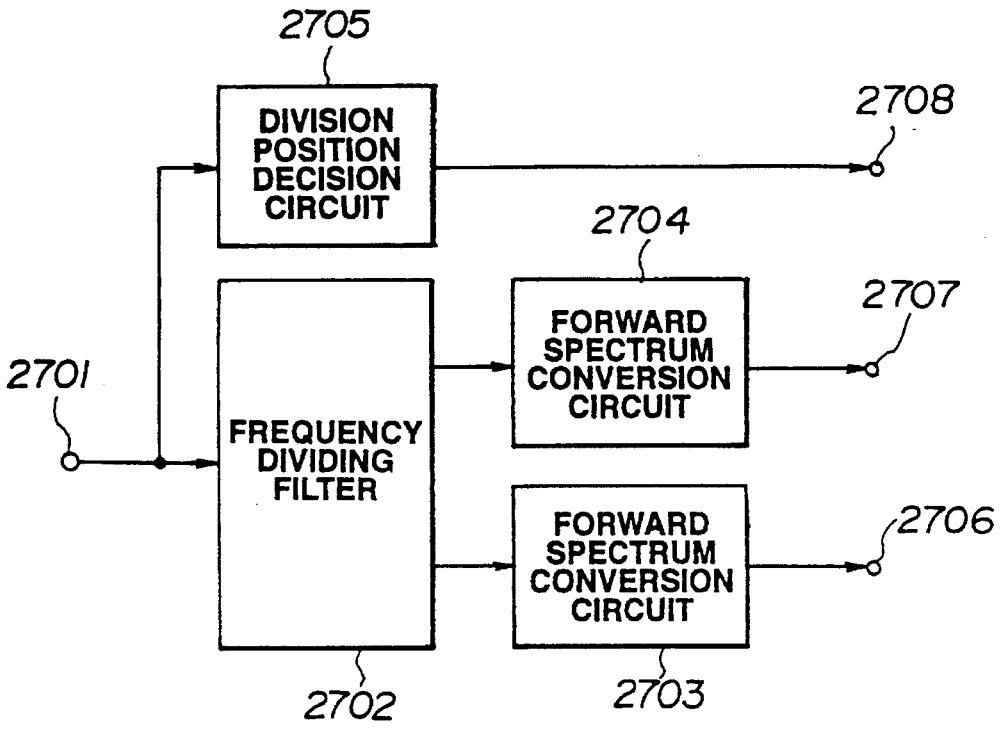
FIG. 26 is a block circuit diagram of a modified frequency dividing circuit.

FIG. 26 shows an arrangement of a modified embodiment.

In the present modification, the input signal is pre-divided by a frequency dividing filter 2702 into two frequency bands before being processed with forward spectrum conversion. In FIG. 26, terminals 2701 and 2708 correspond to the terminals 2501 and 2504 of FIG. 24, respectively, while terminals 2706 and 2707 together correspond to the terminal 2505 of FIG. 24. The dividing position decision circuit 2705 also corresponds to the dividing position decision circuit 2502 of FIG. 24.

The forward spectrum converting circuits 2704 and 2703 perform forward spectrum conversion on associated outputs of the frequency dividing filter 2702. In the arrangement of FIG. 26, the low range output and the high range output of the frequency dividing filter 2702 are transmitted to the forward spectrum conversion circuits 2703 and 2704, respectively. Outputs of the forward spectrum conversion circuits 2703 and 2704 are outputted at output terminals 2706, 2707, respectively.

In the arrangement of FIG. 26, signal samples can be thinned by pre-dividing the frequency by the frequency dividing filter 2702, so that the block length in the calculations of the forward spectrum conversion can be decreased while maintaining the frequency resolution.

Figure 27:
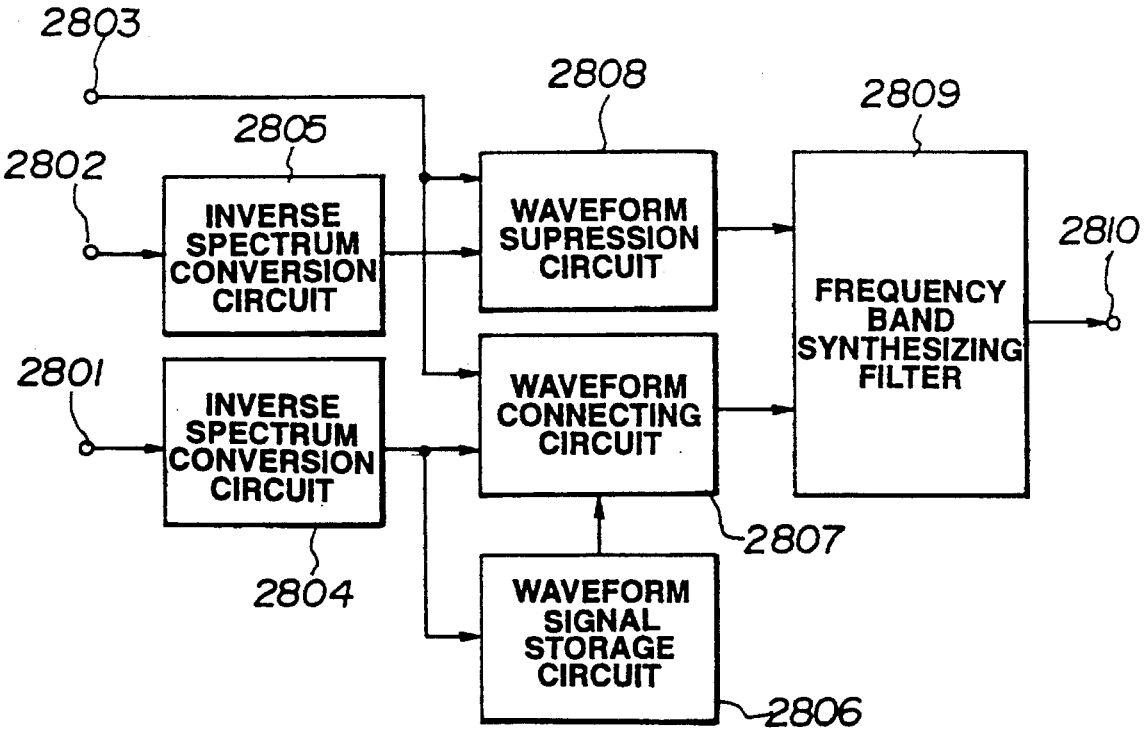
FIG. 27 is a block circuit diagram of a frequency band synthesizing circuit of a decoding device, which is a counterpart of the frequency dividing circuit shown in FIG. 26.

FIG. 27 shows an arrangement of a frequency band synthesizing circuit of a decoding device, which is a counterpart of the frequency dividing circuit of the modification shown in FIG. 26.

Referring to FIG. 27, signals at the terminals 2706, 2707 and 2708 of FIG. 26 are supplied to terminals 2801, 2802 and 2803, respectively. That is, the signal supplied via the terminal 2801 (low range signal) is supplied to an inverse spectrum conversion circuit 2804 where it is processed with inverse spectrum conversion associated with the forward spectrum conversion by the forward spectrum conversion circuit 2703 of FIG. 26 and is subsequently supplied to a waveform connecting circuit 2807. The signal supplied via the terminal 2802 (high range signal) is supplied to an inverse spectrum conversion circuit 2805 where it is processed with inverse spectrum conversion associated with the forward spectrum conversion by the forward spectrum conversion circuit 2704 of FIG. 26 and is subsequently supplied to a waveform suppressing circuit 2807. The waveform connecting circuit 2807 and the waveform suppressing circuit 2808 are also fed with the dividing position information from the terminal 2803.

An output of the inverse spectrum conversion circuit 2804 is stored in a waveform signal storage circuit 2806, an output of which is supplied to the waveform connecting circuit 2807. That is, the waveform connecting circuit 2807 exchanges, based upon the dividing position information, an output of the inverse spectrum conversion circuit 2804 for the low range (pre-set range), that is a signal for a pre-set domain, with a signal modified from a low-range waveform signal of a temporally preceding block stored in the waveform signal storage circuit 2806, that is a signal of a domain other than the pre-set domain of the pre-set band, by way of performing the changeover and connecting operation.

The arrangement of FIG. 27 is characterized by the fact that the modified temporally previous waveform signal is employed only at a band (pre-set band) directly before the domain experiencing a sudden waveform increase, herein a band in the low frequency range. For the other range, that is high frequency range, the signal produced by inverse spectrum conversion by the inverse spectrum conversion circuit 2805 is forcefully suppressed by the waveform suppression circuit 2808 based upon the dividing position information. If the modified temporally preceding waveform signal is used only for the pre-set band, herein the low band, the storage capacity of the waveform signal storage circuit 2806 may be diminished advantageously. The pre-set band is preferably the band in the low range, as in the present embodiment, where the signal energy usually becomes predominant.

The signal produced by waveform connection by the waveform connecting circuit 2807 is free from the pre-echo, as explained previously. Outputs of the waveform connecting circuit 2807 and the waveform suppressing circuit 2808 are routed to a frequency band synthesizing filter 2809 where frequency band synthesis as a counterpart of the frequency division by the frequency dividing filter 2702 is performed. The band-synthesized signal is outputted at a terminal 2810.

One of the major advantages of the decoding by the decoding device of the present embodiment is its compatibility. In the above-described second embodiment, spectrum conversion is separately carried out in a domain directly preceding sudden increase in the waveform, without employing the modified temporally previous block as in the present embodiment, and the resulting spectral information is supplied to the decoding device for preventing the psychoacoustic hindrance produced by the pre-echo.

Specifically, the information encoding method according to the second embodiment resolves waveform signals into spectral components, which spectral components are quantized and encoded. That is, in generating a pre-set signal changeover signal based upon characteristics of waveform signals, resolving the waveform signals into spectral components and quantizing and encoding the spectral signals, the encoding method encodes the signal changeover information and calculates the spectral components a plural number of times for the same domain for a pre-set signal.

With the information decoding method of the present embodiment, the signal changeover information in the above-mentioned previously proposed information encoding method may be employed as the dividing position information in the present invention.

Figure 28:
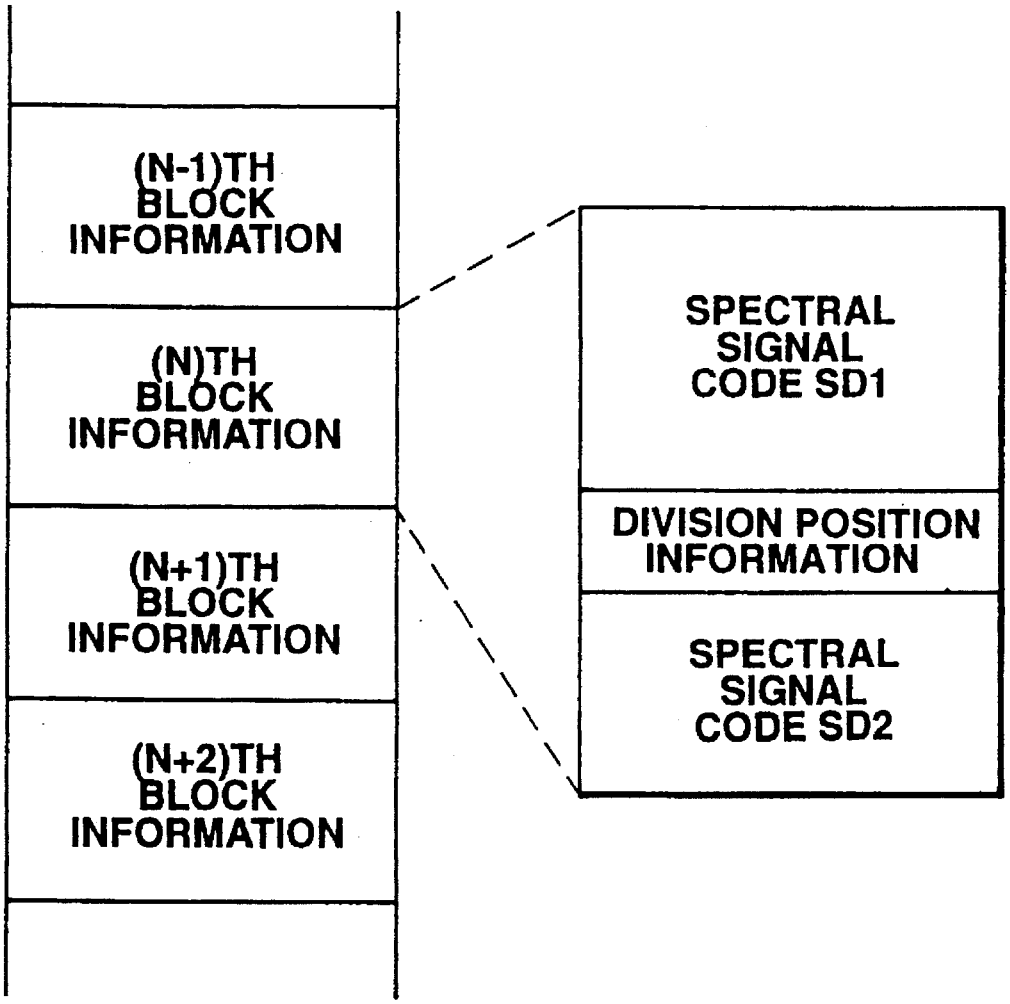
FIG. 28 illustrates an example of the recording method for signals encoded by the encoding method according to a third embodiment.

More specifically, the recording of the code data produced by the above-mentioned previously proposed information encoding method, if combined with the present invention, may be represented as shown in FIG. 28.

Referring to FIG. 28, the first spectrum information, that is an unmodified waveform signal from the encoding device (the spectral signal SD1), the dividing position information or the signal changeover information, and the second spectral information obtained by suppressing the waveform signal posterior to the dividing position to zero by the encoding device (spectral signal code SD2), are recorded in this order as the block information. In FIG. 28, only the information for an arbitrary Nth block is shown. The number of the sub-domains prior to changeover, as shown in FIG. 3, may be recorded as the dividing position information.

The dividing position information equal to zero indicates that the signal waveform changeover synthesis is unnecessary. In such case, the recording of the second spectral information may be omitted. The corresponding signal may be synthesized from two spectral signals of the same block, using the information decoding method according to the second embodiment, or signal synthesis may be made by the decoding by the present decoding device by disregarding the second spectral signal (spectral signal code SD2). Since it suffices with the present information decoding device to perform inverse spectrum conversion only once in the same block, the volume of the processing operations may be correspondingly decreased.

In decoding the information by the decoding device of the present embodiment, the waveform signal separation may be performed when the signal waveform becomes acutely small instead of when the signal waveform is acutely increased. This allows the quantization noise in the decreased signal portion to be reduced. The number of waveform signals, divided from a single signal waveform, may be larger than two, while the number of bands in which to effect signal waveform changeover and synthesis may be two or larger. However, since it is sudden increase in the signal waveform that presents the most serious psychoacoustic problem, it is most effective to employ the decoding such as achieved with the decoding device of the present invention for preventing the pre-echo. Since the waveform signal is synthesized from the waveform signal of the temporally previous domain, the circuit construction may also be simplified.

Although the description has been made with reference to MDCT as an example of spectral conversion, discrete Fourier transform (DFT) or discrete cosine transform (DCT) may also be employed. The present method may also be applied to a case in which, instead of employing special spectral conversion, the input signal is divided in frequency by a filter into band signals, which band signals are quantized and encoded. The frequency components obtained by such filter in the description of the present invention are also termed the spectral signals. The method of the present embodiment may also be applied to multi-channel audio signals as well.

Although the above description has been made with reference to a case in which the quantization noise produced on quantizing audio waveform signals is rendered less perceptible, the present method is also effective in rendering the quantization noise of other kinds of signals less perceptible and may also be applied to, for example, picture signals.

It is seen from above that, with the information decoding device of the present invention, the pre-echo may be prevented without providing for variable conversion domain length, thereby simplifying not only the decoding device but also the encoding device. In addition, since it is unnecessary to perform spectrum conversion or inverse spectrum conversion in each domain redundantly, the volume of the processing operations performed by the encoding device or the decoding device is not increased excessively. On the other hand, since the volume of the spectral information to be recorded or transmitted need not be increased, it becomes possible to improve the compression ratio during encoding.

What is claimed is:

1. An information encoding method for generating encoded input digital data, comprising the steps of:

quantizing spectral signals to generate signal components, the spectral signals based on input digital data;

generating pre-echo information by detecting a period during which quantization noise produced by the quantization of the spectral signals is not masked by the signal components, the pre-echo information indicative of signal components to be suppressed during decoding of the encoded input digital data; and transmitting the pre-echo information.

2. The information encoding method as claimed in claim 1, further comprising the step of:

performing pre-set spectrum conversion on said input digital data to generate said spectral signals.

3. The information encoding method as claimed in claim 2, further comprising the steps of:

dividing said input digital data into plural frequency bands; and performing the pre-set spectrum conversion for each of said frequency bands.

4. The information encoding method as claimed in claim 3, wherein the pre-echo information is determined for each of the frequency bands.

5. The information encoding method as claimed in claim 3, wherein said pre-echo information is determined in common for all of said frequency bands.

6. The information encoding method as claimed in claim 2, wherein a conversion length for said pre-set spectrum conversion is fixed.

7. The information encoding method as claimed in claim 2, further comprising the step of:

performing said pre-set spectrum conversion a plural number of times on said input digital data of a sole domain responsive to said pre-echo information.

8. An information decoding method for decoding encoded digital data, comprising the steps of:

separating quantized signals and pre-echo information from encoded digital data, the pre-echo information indicating spectral signals to be suppressed;

inverse quantizing said quantized signals to generate the spectral signals; and performing a pre-echo preventing operation by suppressing the spectral signals corresponding to the pre-echo information to prevent the occurrence of quantization noise.

9. The information decoding method as claimed in claim 8, further comprising the steps of:

performing inverse spectrum conversion on said spectral signals to generate time domain signals; and performing said pre-echo preventing operation on said time domain signals.

10. The information decoding method as claimed in claim 9, wherein the pre-echo preventing operation reduces to zero values of samples in the domain indicated by the pre-echo information in said time domain signals.

11. The information decoding method as claimed in claim 8, wherein said inverse spectrum conversion is performed for each frequency band and includes the step of:

synthesizing said time domain signals of the plural frequency bands into one decoded signal.

12. The information decoding method as claimed in claim 11, wherein said pre-echo information is independent for each frequency band.

13. The information decoding method as claimed in claim 11, wherein said pre-echo information is common for each frequency band.

14. The information decoding method as claimed in claim 9, wherein a conversion length of said inverse spectrum conversion is fixed.

15. The information decoding method as claimed in claim 9, wherein said spectral signals contain plural spectral signals associated with a sole time domain, and said inverse spectrum conversion comprises the step of:

performing inverse spectrum conversion for each of said plural signals to generate plural time domain signals, and wherein said pre-echo preventing operation comprises the step of:

synthesizing said time domain signals responsive to a changeover position indicated by said pre-echo information.

16. An information decoding method for decoding encoded digital data, comprising the steps of:

separating quantized signals and pre-echo information from encoded digital data;

inverse quantizing said quantized signals to generate spectral signals;

performing a pre-echo preventing operation on said spectral signals depending on said pre-echo information;

performing inverse spectrum conversion on said spectral signals to generate time domain signals; and performing said pre-echo preventing operation on said time domain signals, wherein the pre-echo preventing operation multiplies by a pre-set coefficient in the domain indicated by the pre-echo information in said time domain information.

17. An information encoding method for encoding input digital data, comprising the steps of:

performing twice a pre-set spectrum conversion on said input digital data of a sole domain responsive to pre-echo information to generate said spectral signals, wherein a first spectrum conversion is performed on a first signal whose waveform prior to a changeover position indicated by said pre-echo information is suppressed, and a second spectrum conversion is performed on a second signal whose waveform posterior to the changeover position indicated by said pre-echo information is suppressed;

quantizing spectral signals based on the input digital data;

detecting a period in which pre-echo is produced in the input digital data; and transmitting the pre-echo information for preventing the occurrence of the pre-echo.

18. An information encoding method for encoding input digital data, comprising the steps of:

performing twice a pre-set spectrum conversion on said input digital data of a sole domain responsive to pre-echo information to generate said spectral signals, wherein a first spectrum conversion is performed on a first signal which retains the waveform of said sole domain unchanged, and a second spectrum conversion is performed on a second signal whose waveform posterior to a changeover position indicated by said pre-echo information is suppressed;

quantizing spectral signals based on the input digital data;

detecting a period in which pre-echo is produced in the input digital data; and transmitting the pre-echo information for preventing the occurrence of the pre-echo.

19. An information decoding method for decoding encoded digital data, comprising the steps of:

separating quantized signals and pre-echo information from encoded digital data;

inverse quantizing said quantized signals to generate spectral signals, wherein said spectral signals contain plural spectral signal associated with a sole time domain, and wherein said spectral signals associated with said sole time domain include a first spectrum signal and a second spectrum signal, a first inverse spectrum conversion on said first spectral signal to generate a first time domain signal whose waveform prior to said changeover position is suppressed, and wherein a second inverse spectrum conversion is performed on said second spectral signal to generate a second time domain signal whose waveform posterior to said changeover position is suppressed; and performing a pre-echo preventing operation on said spectral signals depending on said pre-echo information;

performing inverse spectrum conversion for each of said plural spectral signals to generate plural time domain signals; and performing said pre-echo preventing operation on said time domain signals by synthesizing said time domain signals responsive to a changeover position indicated by said pre-echo information.

20. An information decoding method for decoding encoded digital data, comprising the steps of:

separating quantized signals and pre-echo information from encoded digital data;

inverse quantizing said quantized signals to generate spectral signals, wherein said spectral signals contain plural spectral signals associated with a sole time domain, and wherein said spectral signals associated with said sole domain include a first spectrum signal and a second spectrum signal, a first inverse spectrum conversion is performed on said first spectral signal to generate a first time domain signal which retains the waveform of said sole domain unchanged, and wherein a second inverse spectrum conversion is performed on said second spectral signal to generate a second time domain signal whose waveform posterior to said changeover position is suppressed; and performing a pre-echo preventing operation on said spectral signals depending on said pre-echo information;

performing inverse spectrum conversion for each of said plural spectral signals to generate plural time domain signals; and performing said pre-echo preventing operation on said time domain signals by synthesizing said time domain signals responsive to a changeover position indicated by said pre-echo information.

21. An information decoding method for decoding encoded digital data, comprising the steps of:

separating quantized signals and pre-echo information from encoded digital data;

inverse quantizing said quantized signals to generate spectral signals;

performing a pre-echo preventing operation on said spectral signals depending on said pre-echo information;

performing inverse spectrum conversion on said spectral signals to generate time domain signals; and performing said pre-echo preventing operation on said time domain signals, wherein the pre-echo preventing operation comprises the step of replacing a specified sub-domain in said time domain signal indicated by said pre-echo information by a signal which is based on said time domain signal temporally previous to said specified sub-domain.

22. The information decoding method as claimed in claim 21, wherein the signal which is based on said time domain signal is an inverted signal of said signal which is based on said time domain signal temporally previous to said specified domain.

23. The information decoding method as claimed in claim 21, wherein the signal which is based on said time domain signal is a signal consisting of plural reversions of a part of said time domain signal temporally previous to said specified domain.

24. The information decoding method as claimed in claim 21, wherein the signal which is based on said time domain signal is a signal consisting of plural repetitions of a small domain delimited by substantially zero-valued samples of said time domain signal temporally previous to said specified domain.

25. An information encoding apparatus for generating encoded input digital data, comprising:

means for quantizing spectral signals to generate signal components, the spectral signals based on input digital data;

means for generating pre-echo information by detecting a period during which quantization noise produced by the quantization of the spectral signals is not masked by the signal components, the pre-echo information indicative of signal components to be suppressed during decoding of the encoded input digital data; and means for multiplexing said quantized signals and pre-echo information.

26. The information encoding apparatus as claimed in claim 25, further comprising:

means for performing pre-set spectrum conversion on the input digital data to generate said spectral data.

27. The information encoding apparatus as claimed in claim 26, further comprising:

means for dividing the input digital data into plural frequency bands, said spectrum conversion being performed for each frequency band.

28. The information encoding apparatus as claimed in claim 27, wherein the pre-echo information is determined for each of the frequency bands.

29. The information encoding apparatus as claimed in claim 27, wherein said pre-echo information is determined in common for all of said frequency bands.

30. The information encoding apparatus as claimed in claim 26, wherein conversion length for said spectrum conversion is fixed.

31. The information encoding apparatus as claimed in claim 26, wherein the means for performing pre-set spectrum conversion comprises:

means for performing said spectrum conversion a plural number of times on said digital data of a sole domain responsive to said pre-echo information.

32. An information decoding apparatus for decoding encoded digital data, comprising:

means for separating quantized signals and pre-echo information from encoded digital data and inverse quantizing said quantized signals to generate spectral signals, the pre-echo information indicating spectral signals to be suppressed; and means for performing a pre-echo preventing operation by suppressing the spectral signals corresponding to the pre-echo information to prevent the occurrence of quantization noise.

33. The information decoding apparatus as claimed in claim 32, further comprising:

means for performing inverse spectrum conversion on said spectral signals to generate time domain signals, wherein said pre-echo preventing operation is performed on said time domain signals.

34. The information decoding apparatus as claimed in claim 33, wherein said inverse spectrum conversion is performed for each frequency band, further comprising:

means for synthesizing said time domain signals for the plural frequency bands into one decoded signal.

35. The information decoding apparatus as claimed in claim 34, wherein said pre-echo information is independent for each frequency band.

36. The information decoding apparatus as claimed in claim 34, wherein said pre-echo information is common for each frequency band.

37. The information decoding apparatus as claimed in claim 33, wherein a conversion length of said inverse spectrum conversion is fixed.

38. The information decoding apparatus as claimed in claim 33, wherein said spectral signals contain plural spectral signals associated with a sole time domain, said inverse conversion means performs inverse spectrum conversion for each of said plural signals to generate plural time domain signals, and said means for performing a pre-echo preventing operation synthesizing said time domain signals responsive to a changeover position indicated by said pre-echo information.

39. An information decoding apparatus for decoding encoded digital data, comprising:

means for separating quantized signals and pre-echo information from encoded digital data and inverse quantizing said quantized signals to generate spectral signal;

means for performing a pre-echo preventing operation on said spectral signals depending on said pre-echo information; and means for performing inverse spectrum conversion on said spectral signals to generate the domain signals;

said pre-echo preventing operation being performed on said time domain signals, wherein the pre-echo preventing operation reduces values of samples in the domain indicated by the pre-echo information in said time domain signals.

40. An information decoding apparatus for decoding encoded digital data, comprising:

means for separating quantized signals and pre-echo information from encoded digital data and inverse quantizing said quantized signals to generate spectral signal;

means for performing a pre-echo preventing operation on said spectral signals depending on said pre-echo information; and means for performing inverse spectrum conversion on said spectral signals to generate time domain signals, said pre-echo preventing operation being performed on said time domain signals, wherein the pre-echo preventing operation multiplies with a pre-set coefficient in the domain indicated by the pre-echo information in said time domain information.

41. An information encoding apparatus for encoding input digital data, comprising:

means for performing a pre-set spectrum conversion a plural number of times on the input digital data of a sole domain responsive to pre-echo information to generate spectral data, wherein said spectrum conversion is performed twice for said sole time domain, a first spectrum conversion is performed on a first signal whose waveform prior to a changeover position indicated by said pre-echo information is suppressed, and wherein a second spectrum conversion is performed on a second signal whose waveform posterior to the changeover position indicated by said pre-echo information is suppressed;

means for quantizing the spectral data to generate quantized signals;

means for detecting a period in which a pre-echo of the input digital data is generated; and means for multiplexing said quantized signals and pre-echo information for preventing the pre-echo.

42. An information encoding apparatus for encoding input digital data, comprising:

means for performing a pre-set spectrum conversion a plural number of times on the input digital data of a sole domain responsive to pre-echo information to generate spectral data, wherein said spectrum conversion is performed twice for said sole time domain, a first spectrum conversion is performed on a first signal which retains a waveform of said sole domain unchanged, and wherein a second spectrum conversion is performed on a second signal whose waveform posterior to a changeover position indicated by said pre-echo information is suppressed;

means for quantizing the spectral data to generate quantized signals;

means for detecting a period in which a pre-echo of the input digital data is generated; and means for multiplexing said quantized signals and pre-echo information for preventing the pre-echo.

43. An information decoding apparatus for decoding encoded digital data, comprising:

means for separating quantized signals and pre-echo information from encoded digital data and inverse quantizing said quantized signals to generate spectral signals, said spectral signals containing plural spectral signals associated with a sole time domain;

means for performing inverse spectrum conversion for each of said plural spectral signals to generate time domain signals, wherein said spectral signals associated with said sole domain include a first spectrum signal and a second spectrum signal, said inverse conversion means performing a first inverse spectrum conversion on said first spectral signal to generate a first time domain signal whose waveform prior to a changeover position is suppressed, and a second inverse spectrum conversion is performed on said second spectral signal to generate a second time domain signal whose waveform posterior to said changeover position is suppressed; and means for performing on said time domain signals a pre-echo preventing operation depending on said pre-echo information, said means for performing synthesizing said time domain signals responsive to said changeover position indicated by said pre-echo information.

44. An information decoding apparatus for decoding encoded digital data, comprising:

means for separating quantized signals and pre-echo information from encoded digital data and inverse quantizing said quantized signals to generate spectral signals, said spectral signals containing plural spectral signals associated with a sole time domain;

means for performing inverse spectrum conversion for each of said plural spectral signals to generate time domain signals, wherein said spectral signals associated with said sole domain include a first spectrum signal and a second spectrum signal, said inverse conversion means performing a first inverse spectrum conversion on said first spectral signal to generate a first time domain signal which retains a waveform of said sole domain unchanged, and a second inverse spectrum conversion on said second spectral signal to generate a second time domain signal whose waveform posterior to a changeover position is suppressed; and means for performing on said time domain signals a pre-echo preventing operation depending on said pre-echo information, said means for performing synthesizing said time domain signals responsive to said changeover position indicated by said pre-echo information.

45. An information decoding apparatus for decoding encoded digital data, comprising:

means for separating quantized signals and pre-echo information from encoded digital data and inverse quantizing said quantized signals to generate spectral signal;

means for performing a pre-echo preventing operation on said spectral signals depending on said pre-echo information; and means for performing inverse spectrum conversion on said spectral signals to generate time domain signals, said pre-echo preventing operation being performed on said time domain signals, wherein the pre-echo preventing operation replaces a specified sub-domain in said time domain signal indicated by said pre-echo information by a signal which is based on said time domain signal temporally previous to said specified sub-domain.

46. The information decoding apparatus as claimed in claim 45, wherein the signal which is based on said time domain signal is an inverted signal of said signal which is based on said time domain signal temporally previous to said specified domain.

47. The information decoding apparatus as claimed in claim 45, wherein the signal which is based on said time domain signal is a signal consisting of plural reversions of a part of said time domain signal temporally previous to said specified domain.

48. The information decoding apparatus as claimed in claim 45, wherein the signal which is based on said time domain signal is a signal consisting of plural repetitions of a small domain delimited by substantially zero-valued samples of said time domain signal temporally previous to said specified domain.

* * * * *